US006253182B1

(12) United States Patent
Acero

(10) Patent No.: US 6,253,182 B1
(45) Date of Patent: Jun. 26, 2001

(54) METHOD AND APPARATUS FOR SPEECH SYNTHESIS WITH EFFICIENT SPECTRAL SMOOTHING

(75) Inventor: Alejandro Acero, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/198,661

(22) Filed: Nov. 24, 1998

(51) Int. Cl.[7] ..... G10L 5/02; G10L 9/00
(52) U.S. Cl. ..... 704/268; 704/258
(58) Field of Search ..... 704/268, 258

(56) References Cited

U.S. PATENT DOCUMENTS 5,617,507 * 4/1997 Lee et al. ..... 704/258
5,905,972 * 5/1999 Huang et al. ..... 704/268

OTHER PUBLICATIONS

Parsons, TW, Voice and Speech Processing, McGraw Hill, pp. 284–285, Dec. 1987.*

Flanagan et al, Synthetic Voices for Computers, IEEE Spectrum, Oct. 1970.*

A. Acero, "Source–Filter Models for Time–Scale Pitch–Scale Modification of Speech", *IEEE Int. Conf. on Acoustics, Speech, and Signal Procesing*, vol. 2, Seattle, pp. 881–884, May 1998.

X. Huang et al., "Recent Improvements on Microsoft's Trainable Text–to–Speech System: Whistler.", *IEEE International Conference on Acoustics, Speech, and Signal Processing*, Munich, Germany, pp. 959–962, Apr. 1997.

W.B. Kleijn et al., "Transformation and Decomposition of the Speech Signal for Coding.", *IEEE Signal processing Letters*, vol. 1, No. 9, pp. 136–138, 1994.

E. Moulines et al., "Pitch–synchronous Waveform Processing Techniques for Text–to–Speech Synthesis Using Diphones.", *Speech Communication*, vol. 9, No. 5, pp. 453–467, 1990.

Y. Stylianou et al., "High–Quality Speech Modification based on a Harmonic +Noise Model.", *Proc. of Eurospeech Conference*, Madrid, Spain, pp. 451–554, 1995.

* cited by examiner

*Primary Examiner*—Fan Tsang
*Assistant Examiner*—Robert Louis Sax
(74) *Attorney, Agent, or Firm*—Theodore M. Magee; Westman, Champlin & Kelly, P.A.

(57) ABSTRACT

The present invention provides a method for synthesizing speech by modifying the prosody of individual components of a training speech signal and then combining the modified speech segments. The method includes selecting an input speech segment and identifying an output prosody. The prosody of the input speech segment is then changed by independently changing the prosody of a voiced component and an unvoiced component of the input speech signal. These changes produce an output voiced component and an output unvoiced component that are combined to produce an output speech segment. The output speech segment is then combined with other speech segments to form synthesized speech.

20 Claims, 14 Drawing Sheets

METHOD AND APPARATUS FOR SPEECH SYNTHESIS WITH EFFICIENT SPECTRAL SMOOTHING

BACKGROUND OF THE INVENTION

The present invention relates to speech synthesis. In particular, the present invention relates to time and pitch scaling in speech synthesis.

Text-to-speech systems have been developed to allow computerized systems to communicate with users through synthesized speech. Concatenative speech synthesis systems convert input text into speech by generating small speech segments for small units of the text. These small speech segments are then concatenated together to form the complete speech signal.

To create the small speech segments, a text-to-speech system accesses a database that contains samples of a human trainer's voice. The samples are generally grouped in the database according to the speech units they are taken from. In many systems, the speech units are phonemes, which are associated with the individual sounds of speech. However, other systems use diphones (two phonemes) or triphones (three phonemes) as the basis for their database.

The number of bits that can be used to describe each sample for each speech unit is limited by the memory of the system. Thus, text-to-speech systems generally cannot store values that exactly describe the training speech units. Instead, text-to-speech systems only store values that approximate the training speech units. This causes an approximation error in the stored samples, which is sometimes referred to as a compression error.

The number of examples of each speech unit that can be stored for the speech system is also limited by the memory of the computer system. Different examples of each speech unit are needed because the speech units change slightly depending on their position within a sentence and their proximity to other speech units. In particular, the pitch and duration of the speech unit, also known as the prosody of the speech unit, will change significantly depending on the speech unit's location. For example, in the sentence "Joe went to the store" the speech units associated with the word "store" have a lower pitch than in the question "Joe went to the store?"

Since the number of examples that can be stored for each speech unit is limited, a stored example may not always match the prosody of its surrounding speech units when it is combined with other units. In addition, the transition between concatenated speech units is sometimes discontinuous because the speech units have been taken from different parts of the training session.

To correct these problems, the prior art has developed techniques for changing the pitch and duration of a stored speech unit so that the speech unit better fits the context in which it is being used. An example of one such prior art technique is the so-called Time-Domain Pitch-Synchronous Overlap-and-Add (TD-PSOLA) technique, which is described in "Pitch-Synchronous Waveform Processing Techniques for Text-to-Speech Synthesis using Diphones", E. Moulines and F. Charpentier, Speech Communication, vol. 9, no. 5, pp. 453–467, 1990. Using this technique, the prior art increases the pitch of a speech unit by identifying a section of the speech unit responsible for the pitch. This section is a complex waveform that is a sum of sinusoids at multiples of a fundamental frequency $F_0$. The pitch period is defined by the distance between two pitch peaks in the waveform. To increase the pitch, the prior art copies a segment of the complex waveform that is as long as the pitch period. This copied segment is then shifted by some portion of the pitch period and reinserted into the waveform. For example, to double the pitch, the copied segment would be shifted by one-half the pitch period, thereby inserting a new peak half-way between two existing peaks and cutting the pitch period in half.

To lengthen a speech unit, the prior art copies a section of the speech unit and inserts the copy into the complex waveform. In other words, the entire portion of the speech unit after the copied segment is time-shifted by the length of the copied segment so that the duration of the speech unit increases.

Unfortunately, these techniques for modifying the prosody of a speech unit have not produced completely satisfactory results. As such, a new technique is needed for modifying the pitch and duration of speech units during speech synthesis.

SUMMARY OF THE INVENTION

The present invention provides a method for synthesizing speech by modifying the prosody of individual components of a training speech signal and then combining the modified speech segments. The method includes selecting an input speech segment and identifying an output prosody. The prosody of the input speech segment is then changed by independently changing the prosody of a voiced component and an unvoiced component of the input speech signal. These changes produce an output voiced component and an output unvoiced component that are combined to produce an output speech segment. The output speech segment is then combined with other speech segments to form synthesized speech.

In another embodiment of the invention, a time-domain training speech signal is converted into frequency-domain values that are quantized into codewords. The codewords are retrieved based on an input text and are filtered to produce a descriptor function. The filtering limits the rate of change of the descriptor function. Based on the descriptor function, an output set of frequency-domain values are identified, which are then converted into time-domain values representing portions of the synthesized speech.

By filtering the codewords to produce a descriptor function, the present invention is able to reduce the effects of compression error inherent in quantizing the frequency-domain values into codewords and is able to smooth out transitions between and within speech units.

Other aspects of the invention include using the descriptor function to identify frequency-domain values at time marks associated with an output prosody that is different than the input prosody of the training speech signal.

BRIEF DESCRIPTION OF THE DRAWINGS

FIG. 3-1 is a graph of a speech signal in the time-domain.

FIG. 3-2 is graph of an unvoiced portion of the speech signal FIG. 3-1.

FIG. 3-3 is a graph of a mixed portion of the speech signal FIG. 3-1.

FIG. 3-4 is a graph of a voiced component of the mixed portion FIG. 3-3.

FIG. 3-5 is a graph of the unvoiced component of the mixed portion of FIG. 3-3.

FIG. 4 is a graph of a pitch track for a declarative sentence.

FIG. 5 is a graph of a pitch track of a question.

FIG. 6-1 is a graph of a speech signal showing pitch modification of the prior art.

FIG. 6-2 is a graph of speech signal showing time lengthening of the prior art.

FIG. 8-1 is a graph of a speech signal.

FIGS. 8-2, 8-3 and 8-4 are graphs of progressive time windows.

FIGS. 8-5, 8-6 and 8-7 are graphs of samples of the speech signal of FIG. 8-1 created through the time windows of FIGS. 8-2, 8-3 and 8-4.

FIGS. 11-1, 11-2 and 11-3 are graphs of the contribution of three respective frequencies over time to the mixed portion of the speech signal $E_M$.

FIGS. 12-1, 12-2 and 12-3 are graphs of the contribution of three respective frequencies over time for the voiced component $V_m$ of the mixed portion of the speech signal.

FIGS. 13-1, 13-2 and 13-3 are graphs of the contribution of three respective frequencies over time for the unvoiced component $U_m$ of the mixed portion of the speech signal.

DETAILED DESCRIPTION OF ILLUSTRATIVE EMBODIMENTS

Figure 1:
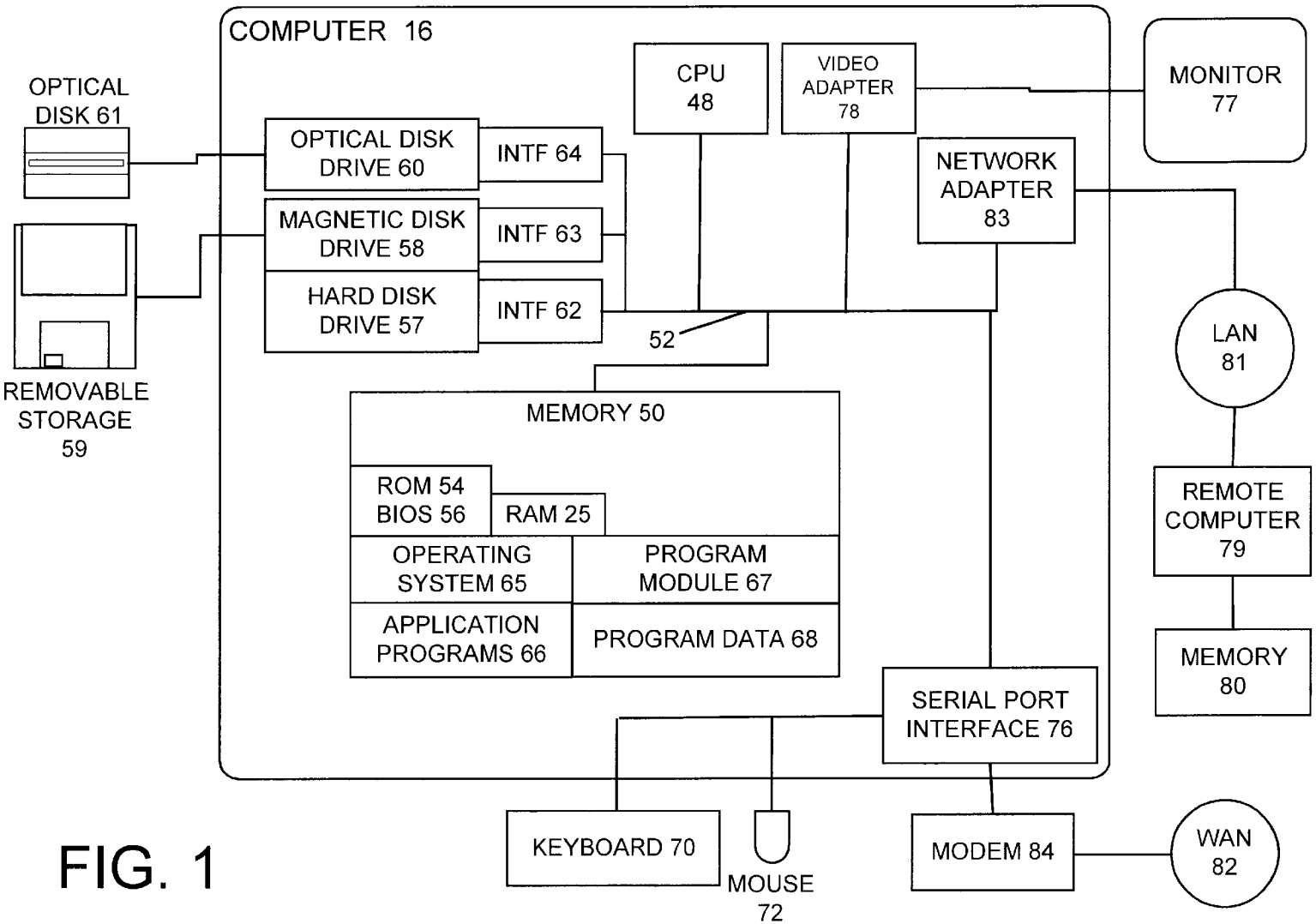
FIG. 1 is a plan view of a computer environment in which the present invention may be practiced.

FIG. 1 and the related discussion are intended to provide a brief, general description of a suitable desktop computer 16 in which portions of the invention may be implemented. Although not required, the invention will be described, at least in part, in the general context of computer-executable instructions, such as program modules, being executed by a personal computer 16 a wireless push server 20 or mobile device 18. Generally, program modules include routine programs, objects, components, data structures, etc. that perform particular tasks or implement particular abstract data types. Moreover, those skilled in the art will appreciate that desktop computer 16 may be implemented with other computer system configurations, including multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing desktop computer 16 includes a general purpose computing device in the form of a conventional personal computer 16, including processing unit 48, a system memory 50, and a system bus 52 that couples various system components including the system memory 50 to the processing unit 48. The system bus 52 may be any of several types of bus structures including a memory bus or memory controller, a peripheral bus, and a local bus using any of a variety of bus architectures. The system memory 50 includes read only memory (ROM) 54, and a random access memory (RAM) 55. A basic input/output system (BIOS) 56, containing the basic routine that helps to transfer information between elements within the desktop computer 16, such as during start-up, is stored in ROM 54.

The desktop computer 16 further includes a hard disc drive 57 for reading from and writing to a hard disc (not shown), a magnetic disk drive 58 for reading from or writing to removable magnetic disc 59, and an optical disk drive 60 for reading from or writing to a removable optical disk 61 such as a CD ROM or other optical media. The hard disk drive 57, magnetic disk drive 58, and optical disk drive 60 are connected to the system bus 52 by a hard disk drive interface 62, magnetic disk drive interface 63, and an optical drive interface 64, respectively. The drives and the associated computer readable media provide nonvolatile storage of computer readable instructions, data structures, program modules and other data for the desktop computer 16. Although the exemplary environment described herein employs a hard disk, a removable magnetic disk 59, and a removable optical disk 61, it should be appreciated by those skilled in the art that other types of computer readable media that can store data and that is accessible by a computer, such as magnetic cassettes, flash memory cards, digital video disks (DVDs), Bernoulli cartridges, random access memories (RAMs), read only memory (ROM), and the like, may also be used in the exemplary operating environment.

A number of program modules may be stored on the hard disk, magnetic disk 59, optical disk 61, ROM 54 or RAM 55, including an operating system 65, one or more application programs 66 (which may include PIMs), other program modules 67 (which may include synchronization component 26), and program data 68.

A user may enter commands and information into desktop computer 16 through input devices such as a keyboard 70, pointing device 72 and microphone 74. Other input devices (not shown) may include a joystick, game pad, satellite dish, scanner, or the like. These and other input devices are often connected to processing unit 48 through a serial port interface 76 that is coupled to the system bus 52, but may be connected by other interfaces, such as a sound card, a parallel port, game port or a universal serial bus (USB). A monitor 77 or other type of display device is also connected to the system bus 52 via an interface, such as a video adapter 78. In addition to the monitor 77, desktop computers may typically include other peripheral output devices such as speakers or printers.

Desktop computer 16 may operate in a networked environment using logic connections to one or more remote computers (other than mobile device 18), such as a remote computer 79. The remote computer 79 may be another personal computer, a server, a router, a network PC, a peer device or other network node, and typically includes many or all of the elements described above relative to desktop computer 16, although only a memory storage device 80 has been illustrated in FIG. 1. The logic connections depicted in FIG. 1 include a local area network (LAN) 81 and a wide area network (WAN) 82. Such networking environments are commonplace in offices, enterprise-wide computer network intranets and the Internet.

When used in a LAN networking environment, desktop computer 16 is connected to the local area network 81 through a network interface or adapter 83. When used in a WAN networking environment, desktop computer 16 typically includes a modem 84 or other means for establishing communications over the wide area network 82, such as the Internet. The modem 84, which may be internal or external, is connected to the system bus 52 via the serial port interface 76. In a network environment, program modules depicted may be stored in the remote memory storage devices. It will be appreciated that the network connections shown are exemplary and other means of establishing a communications link between the computers may be used.

Desktop computer 16 runs operating system 65, which is typically stored in non-volatile memory 54 and executes on processor 48. One suitable operating system is a Windows brand operating system sold by Microsoft Corporation, such as Windows 95, Windows 98 or Windows NT, operating systems, other derivative versions of Windows brand operating systems, or another suitable operating system. Other suitable operating systems include systems such as the Macintosh OS sold from Apple Corporation, and the OS/2 Presentation Manager sold by International Business Machines (IBM) of Armonk, N.Y.

Application programs are preferably stored in program module 67, in volatile memory or non-volatile memory, or can be loaded into any of the components shown in FIG. 1 from disc drive 59, CDROM drive 61, downloaded from a network via network adapter 83, or loaded using another suitable mechanism.

A dynamically linked library (DLL), comprising a plurality of executable functions is associated with PIMs in the memory for execution by processor 48. Interprocessor and intercomponent calls are facilitated using the component object model (COM) as is common in programs written for Microsoft Windows brand operating systems. Briefly, when using COM, a software component such as DLL has a number of interfaces. Each interface exposes a plurality of methods, which can be called individually to utilize different services offered by the software component. In addition, interfaces are provided such that methods or functions can be called from other software components, which optionally receive and return one or more parameter arguments.

Figure 2:
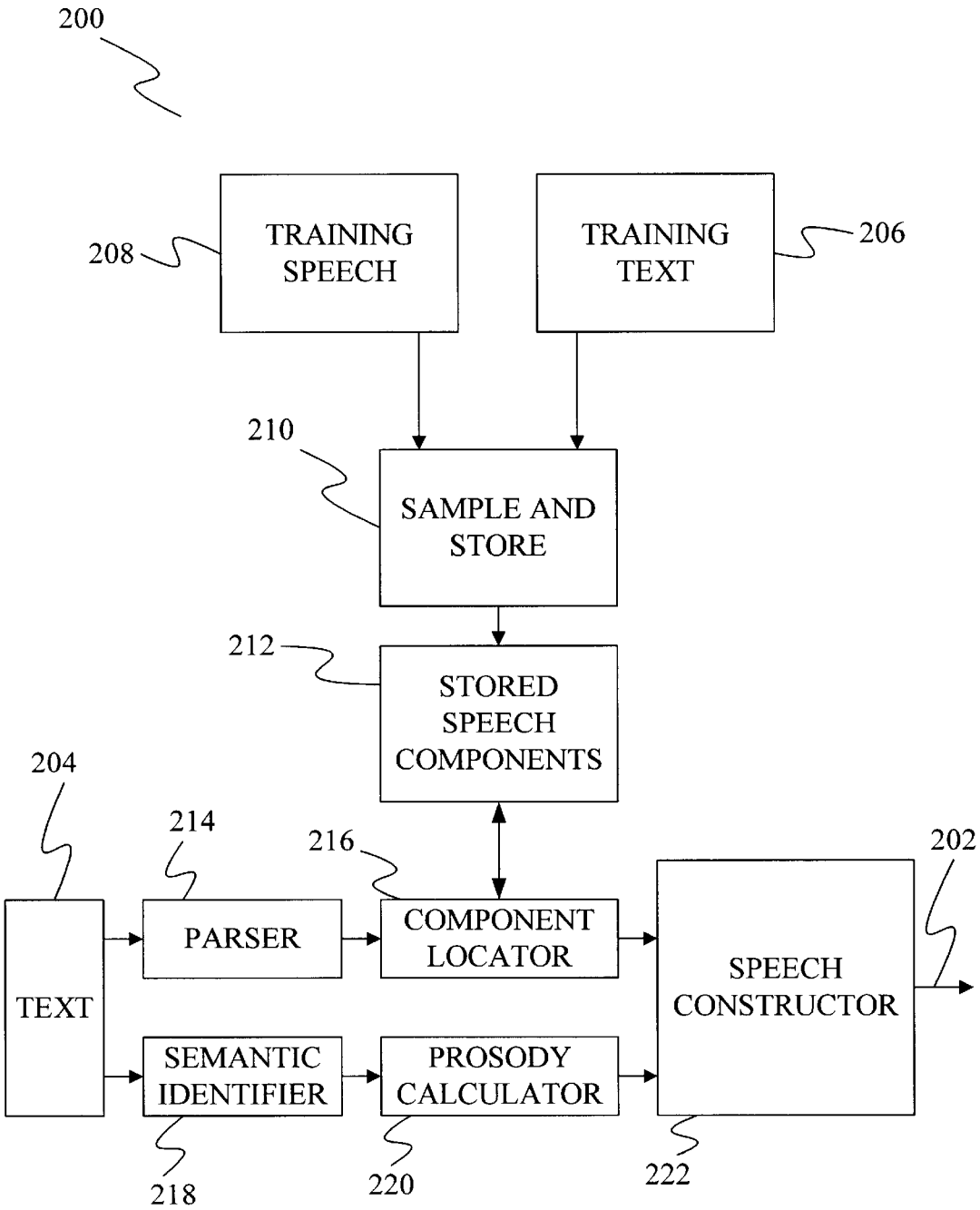
FIG. 2 is a block diagram of a speech synthesizer.

FIG. 2 is a block diagram of a speech synthesizer 200 that is capable of constructing synthesized speech 202 from an input text 204. Before speech synthesizer 200 can be utilized to construct speech 202, it must be trained. This is accomplished using a training text 206 that is read into the speech synthesizer 200 as training speech 208.

A sample and store circuit 210 breaks training speech 208 into individual speech units such as phonemes, diphones or triphones based on training text 206. Sample and store circuit 210 also samples each of the speech units and stores the samples as stored speech components 212 in a memory location associated with speech synthesizer 200.

In many embodiments, training text 206 includes over 10,000 words. As such, not every variation of a phoneme, diphone or triphone found in training text 206 can be stored in stored speech components 212. Instead, in most embodiments, sample and store 210 selects and stores only a subset of the variations of the speech units found in training text 206. The variations stored can be actual variations from training speech 208 or can be composites based on combinations of those variations.

Once speech synthesizer 200 has been trained, input text 204 can be parsed into its component speech units by parser 214. The speech units produced by parser 214 are provided to a component locator 216 that accesses stored speech units 212 to retrieve the stored samples for each of the speech units produced by parser 214. In particular, component locator 216 examines the neighboring speech units around a current speech unit of interest and based on these neighboring units, selects a particular variation of the speech unit stored in stored speech components 212. Thus, if the speech unit is the phoneme found in the vowel sound of "6", component locator 216 will attempt to locate stored samples for a variation of that phoneme that appeared in the training text after a phoneme having a sound similar to "S" and before a phoneme having a sound similar to "X". Based on this retrieval process, component locator 216 provides a set of training samples for each speech unit provided by parser 214.

Text 204 is also provided to a semantic identifier 218 that identifies the basic linguistic structure of text 204. In particular, semantic identifier 218 is able to distinguish questions from declarative sentences, as well as the location of commas and natural breaks in text 204.

Based on the semantics identified by semantic identifier 218, a prosody calculator 220 calculates the desired pitch and duration needed to ensure that the synthesized speech does not sound mechanical or artificial. In many embodiments, the prosody calculator uses a set of prosody rules developed by a linguistics expert.

Prosody calculator 220 provides its prosody information to a speech constructor 222, which also receives training samples from component locator 216. When speech constructor 222 receives the speech components from component locator 216, the components have their original prosody as taken from training speech 208. Since this prosody may not match the output prosody calculated by prosody calculator 220, speech constructor 222 must modify the speech components so that their prosody matches the output prosody produced by prosody calculator 220. Speech constructor 222 then combines the individual components to produce synthesized speech 202. Typically, this combination is accomplished using a technique known as overlap-and-add where the individual components are time shifted relative to each other such that only a small portion of the individual components overlap. The components are then added together.

Figures 1, 3:
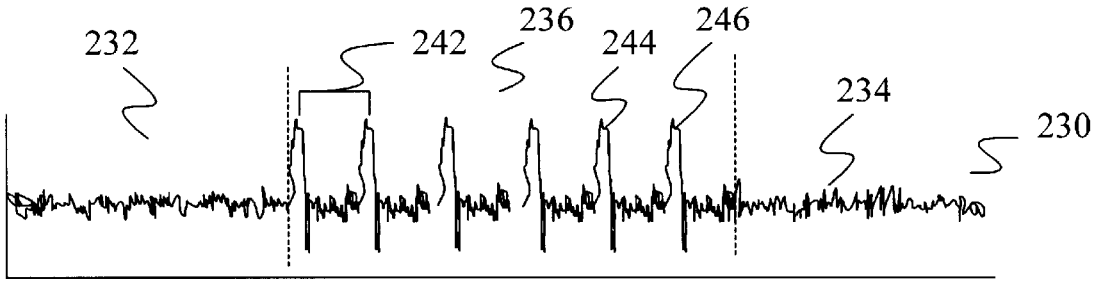
Figures 2, 3:
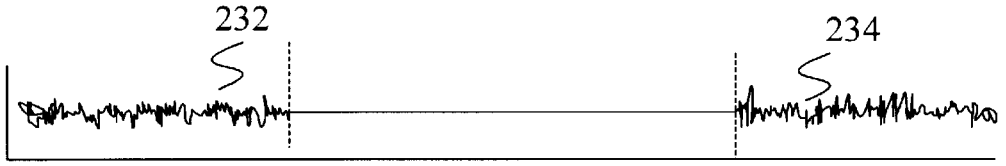
Figure 3:
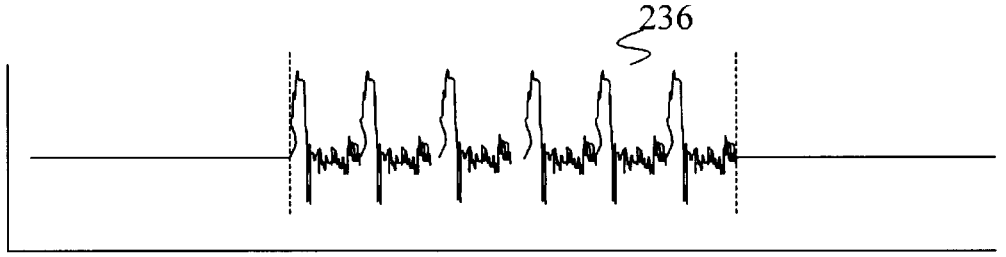

FIG. 3-1 is a graph of a training speech signal 230, which is an example of a section of a speech signal found in training speech 208. Speech section 230 includes three portions, two purely unvoiced portions 232 and 234, and a mixed portion 236 that includes both voiced and unvoiced components. Unvoiced portions 232 and 234 are produced by the speaker when air flows through the speaker's larynx without being modulated by the vocal cords. Examples of phonemes that create unvoiced sounds include "S" as in "six". Mixed portions of speech section 230, such as mixed portion 236, are constructed as a combination of sounds created by the vocal cords of the speaker and sounds created in the mouth of the speaker.

Mixed portion 236 of speech segment 230 carries the pitch of the speech segment. The pitch is a combination of frequencies found in mixed portion 236, but is generally driven by a dominant frequency. In FIG. 3-1, this dominant frequency appears as peaks in mixed portion 326 such as peaks 244 and 246, which represent separate peaks of a repeating waveform 242.

Note that waveform 242 changes slightly over the course of mixed portion 236 resulting in a small change in pitch. The pitch period at any one time in mixed portion 236 can be determined by measuring the distance between the large peaks of mixed portion 236 such as peaks 244 and 246.

Figures 3, 4:
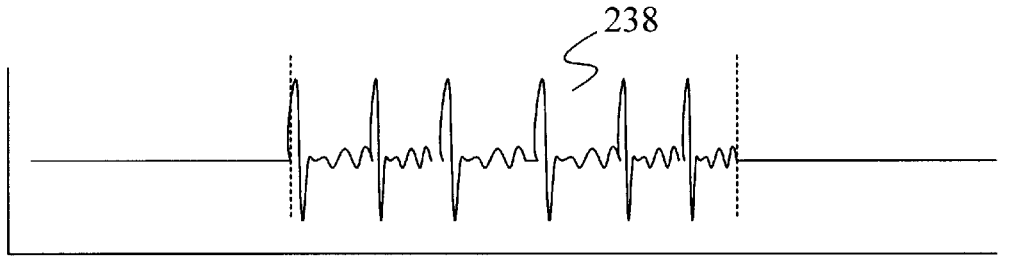
Figures 3, 4, 5:
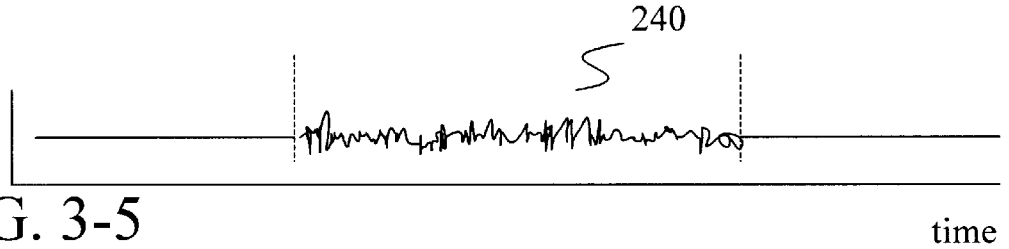
Figure 4:
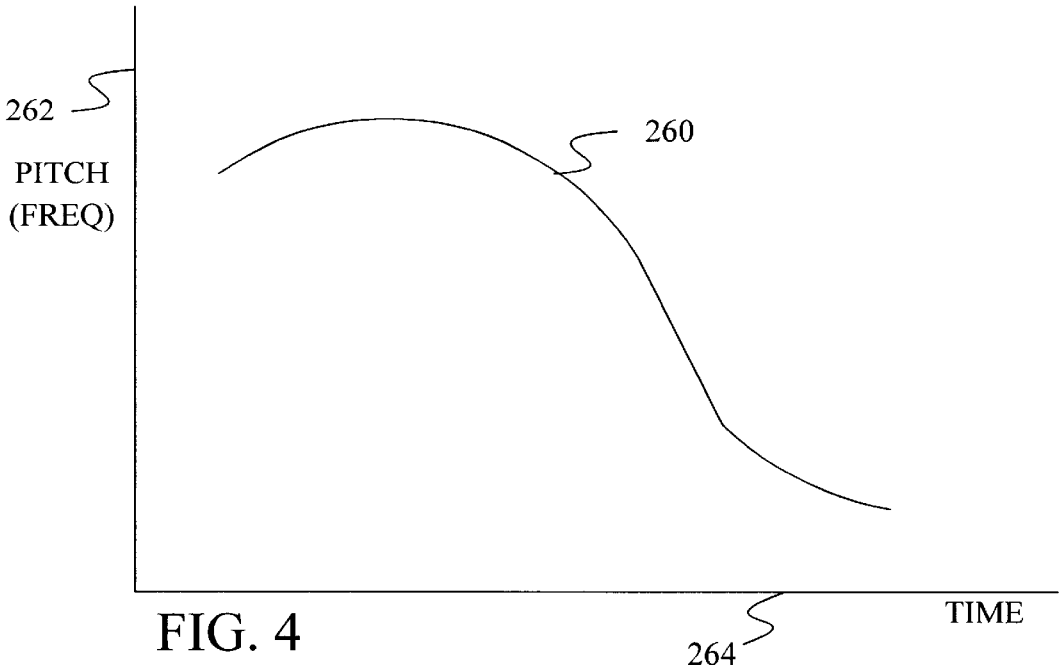
Figure 5:
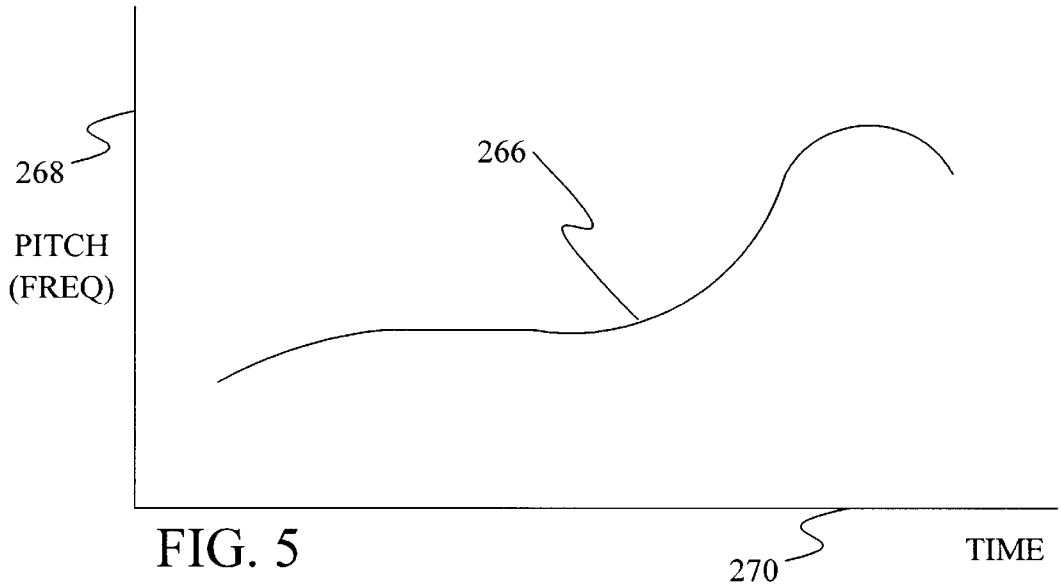

FIG. 3-2 is a graph of speech signal 230 with mixed portion 236 filtered from the signal leaving unvoiced portions 232 and 234. FIG. 3-3 is a graph of speech signal 230 with the unvoiced portions filtered leaving only mixed portion 236. FIGS. 3-4 and 3-5 are graphs of a voiced component 238 and an unvoiced component 240, respectively, of mixed portion 236. Voiced component 238 represents the signal produced by the vocal cords of the speaker and contains the pitch of the speech signal.

The pitch found in a speech segment is indicative of the structure and meaning of the sentence in which the segment is found. An example of a pitch track 260 for a declarative statement is shown in FIG. 4, where pitch 262 is shown on the vertical axis 262 and time is shown on the horizontal axis 264. Pitch track 260 is characterized by a small rise in pitch in the beginning of the declarative sentence and a gradual decrease in pitch until the end of the sentence. Pitch track 260 can be heard in declarative statements such as "Joe went to the store." If these same words are converted into a question, the pitch changes to a pitch track 266 shown in FIG. 5. In FIG. 5, pitch is shown along the vertical axis 268 and time is shown along the horizontal axis 270. Pitch track 266 begins with a low pitch and ends with a much higher pitch. This can be heard in the question "Joe went to the store?"

Figures 1, 6:
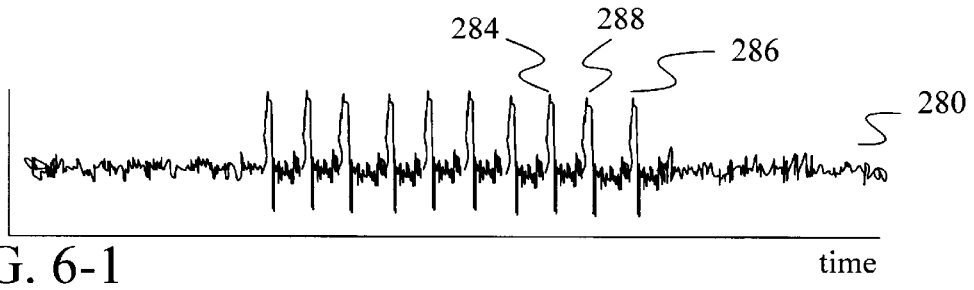
Figures 2, 6:
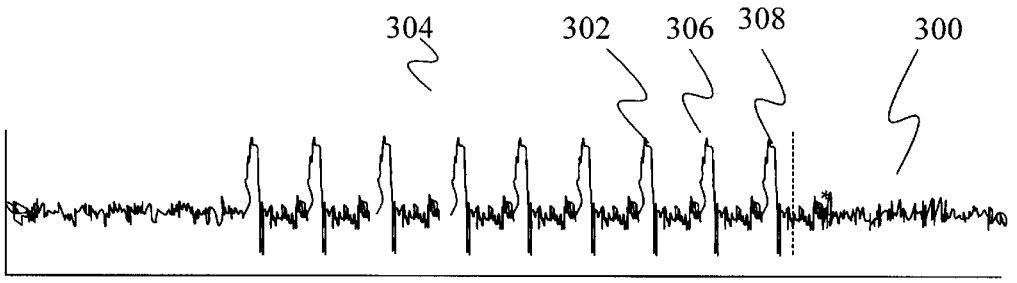

In speech controller 222 of FIG. 2, the pitch and duration of the speech units are changed to meet the prosody determined by prosody calculator 220. In the prior art, the pitch of a phoneme was generally changed by changing the period between the waveforms of the mixed portions of the speech signal. An example of increasing a pitch of a speech signal is shown in speech signal 280 of FIG. 6-1. Speech signal 280 is constructed from speech signal 230 of FIG. 3-1 by inserting additional pitch waveforms within mixed portion 236 of signal 230. This can be seen in FIG. 6-1 where the waveforms associated with peaks 284 and 286 correspond to the waveforms associated with peaks 244 and 246 of speech signal 230. In FIG. 6-1, the pitch period is cut in half by inserting an additional waveform 288 between waveforms 284 and 286, thereby doubling the pitch of the speech signal.

To produce waveform 288, the prior art generally uses two different techniques. In one technique, the prior art makes a copy of the waveform associated with one of the neighboring peaks such as peak 284 or peak 286 and uses this copy as the additional waveform. In the second method, the prior art interpolates the waveform associated with peak 288 based on the waveforms associated with peaks 284 and 286. In such methods, the waveform associated with peak 288 is a weighted average of the waveforms associated with peaks 284 and 286.

The present inventors have discovered that both of these techniques for modifying pitch produce undesirable speech signals. In the method that merely makes a copy of a neighboring waveform to generate a new waveform, the present inventors have discovered that the resulting waveform has a "buzziness" that is caused by the exact repetition of unvoiced components in the speech signal. In normal speech, the unvoiced component of the speech signal does not repeat itself, but instead appears as generally random sounds. By exactly repeating the unvoiced component in the inserted waveform, the prior art introduces a pattern into the unvoiced component that can be detected by the human ear.

In the interpolation technique of the prior art that averages two neighboring waveforms to produce a new waveform, the unvoiced components of the two neighboring waveforms cancel each other out. This results in the removal of the unvoiced component from the inserted waveform and produces a metallic or artificial quality to the synthesized speech.

FIG. 6-2 shows a graph of a speech signal 300 that has been lengthened under a technique of the prior art. In FIG. 6-2, signal 300 is a lengthened version of speech signal 230 of FIG. 3-1 that is produced by adding waveforms to the mixed portion of speech signal 230. In speech signal 300, the waveform associated with peak 302 is the same as the waveform associated with peak 246 of FIG. 3-1. In the prior art, mixed portion 304 of speech signal 300 was lengthened by making duplicate copies of the pitch waveform associated with peak 302, resulting in pitch waveforms 306 and 308. Since waveforms 306 and 308 are exact copies of the waveform associated with peak 302, the unvoiced components of the waveform of peak 302 are duplicated in waveforms 306 and 308. As discussed above, such repetition of unvoiced components causes a "buzziness" in the speech signal that can be detected by the human ear. Thus, the prior art techniques for prosody modification, including pitch and time modification introduce either "buzziness" or a metallic quality to the speech signal.

Figure 7:
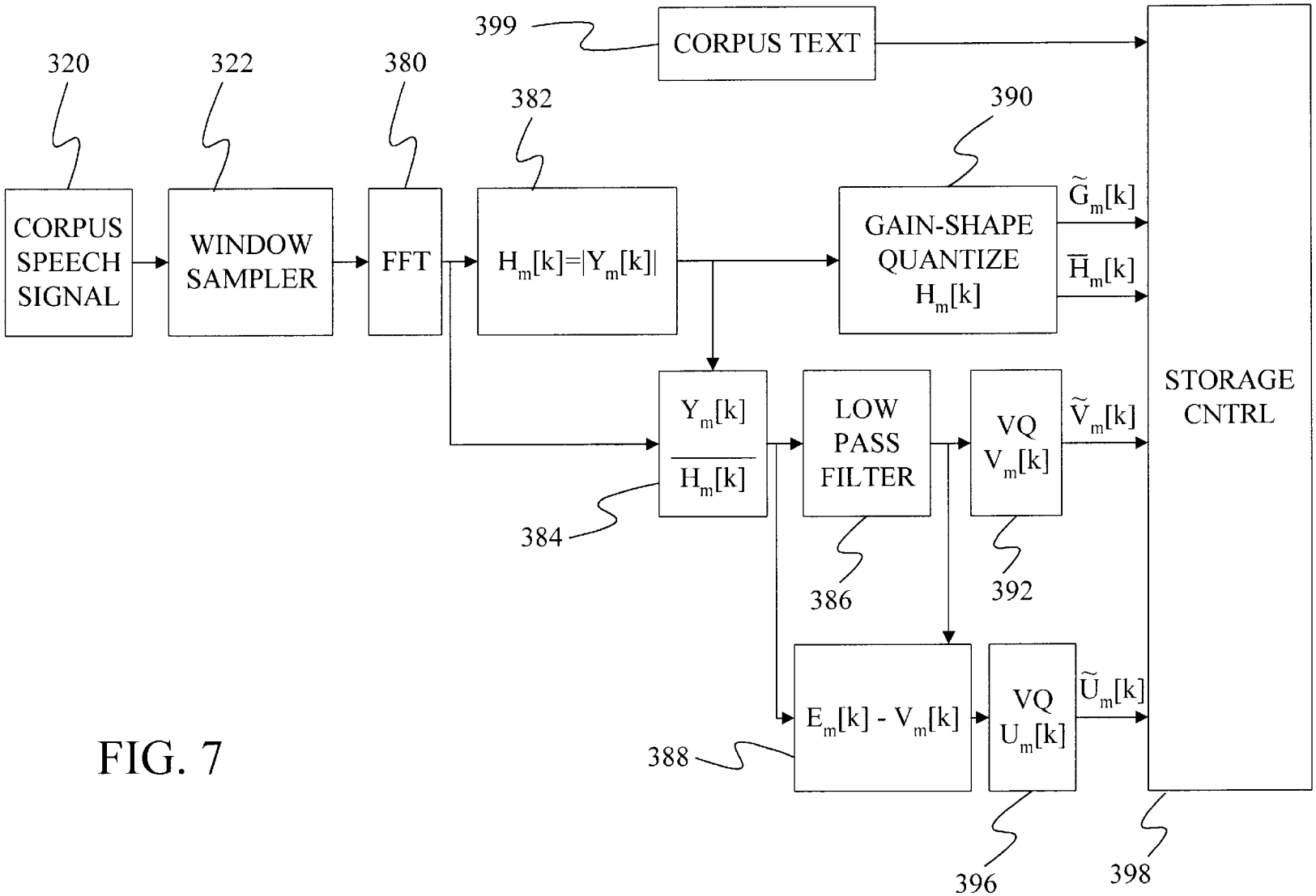
FIG. 7 is a block diagram of a training system under the present invention for training a speech synthesis system.
Figure 15:
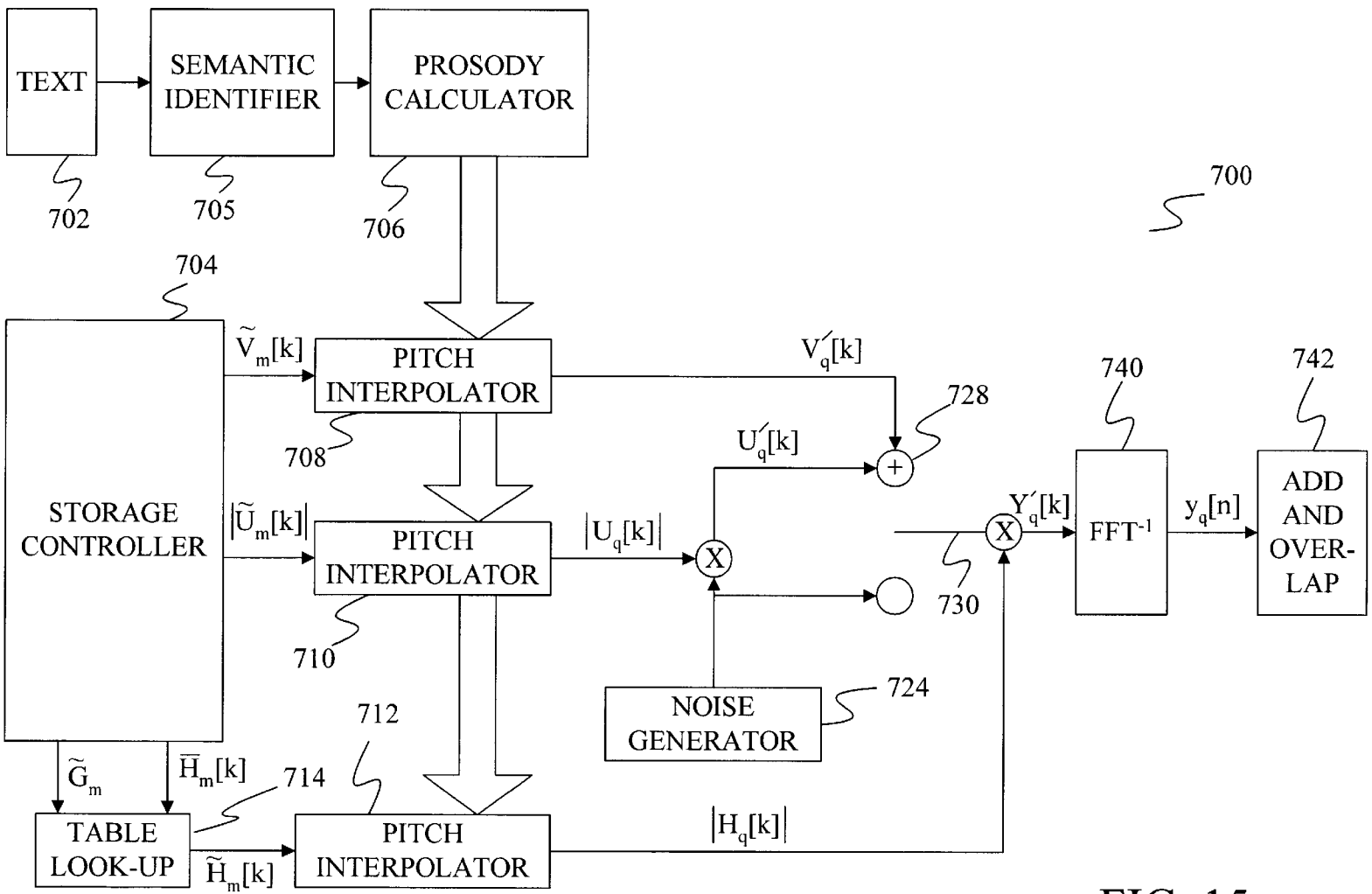
FIG. 15 is a more detailed block diagram of the speech synthesizing portion of the present invention.

The present invention provides a method for changing prosody in synthesized speech without introducing "buzziness" or metallic sounds into the speech signal. Detailed block diagrams of the present invention are shown in FIGS. 7 and 15. FIG. 7 depicts the portion of the present invention used to train the speech synthesizer. FIG. 15 depicts the portions of the speech synthesizer used to create the synthesized speech from input text and the stored training values.

In FIG. 7, a corpus speech signal 320 produced by a human trainer is passed through a window sampler 322, which multiplies the corpus speech signal by time shifted windows to produce sample windows of the speech signal. This sampling can be seen more clearly in FIGS. 8-1, 8-2, 8-3, 8-4, 8-5, 8-6 and 8-7.

Figures 1, 8:
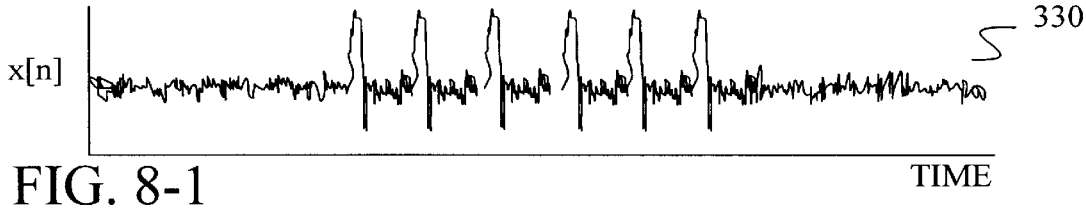
Figures 2, 8:
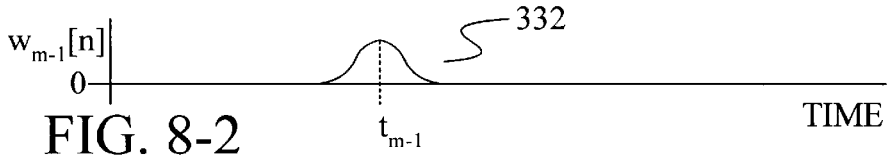
Figures 3, 8:
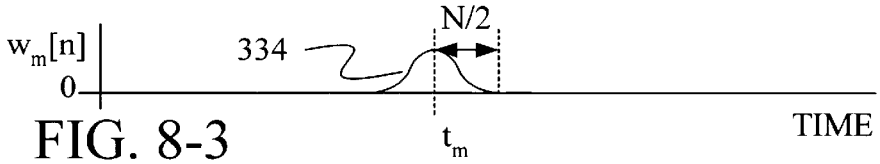
Figures 4, 8:
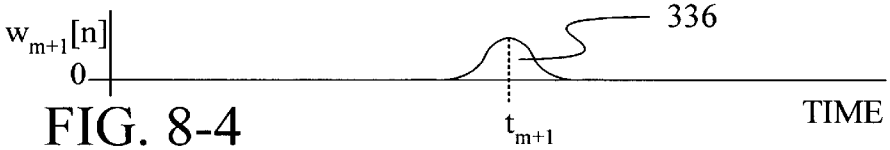
Figures 5, 8:
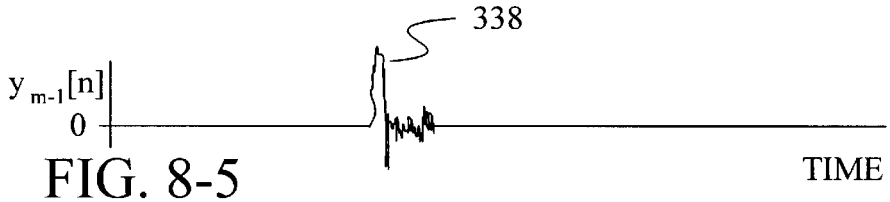
Figures 6, 8:
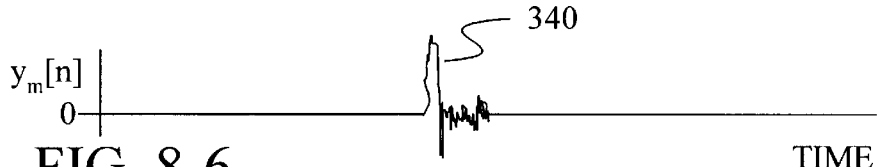
Figures 7, 8:
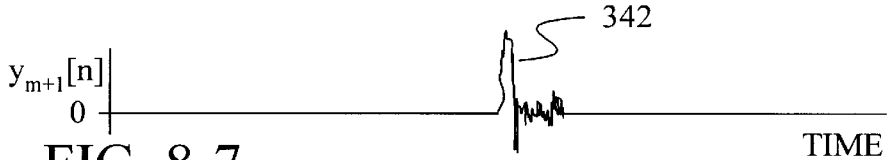

In FIG. 8-1 a speech signal 330 is shown with voltage on the vertical axis and time on the horizontal axis. FIGS. 8-2, 8-3 and 8-4 show three respective timing windows $W_{m-1}(n)$, $W_m(n)$ and $W_{m+1}(n)$, which are each shifted by one time period from one another. In many embodiments, the windows are Hanning windows defined by:

$$w_m[n] = \begin{cases} 0.5 + 0.5\cos(\pi n / L(m)) & |n| < L(m) \\ 0 & |n| > L(m) \end{cases} \qquad \text{EQ1}$$

With m representing the offset of the window and L(m) being defined by:

$$L(m) = \min\,(t_m - t_{m-1}, t_{m+1} - t_m, N/2) \qquad \text{EQ2}$$

Where $t_m$ is a current time mark located at the center of the current window, $t_m-1$ is a time mark centered at a previous window, $t_m+1$ is the time mark centered at a next window and N is the width of the current window. Under most embodiments of the invention, each of the time marks $t_m$ coincide with epochs in the signal, which occur when the vocal folds close.

FIG. 8-3 shows a current sampling window 334 centered at time mark $t_m$ and having a half width of N/2. FIGS. 8-2 and 8-3 show previous timing window 332 and next timing window 336, respectively, which are centered at timing marks $t_{m-1}$ and $t_{m+1}$, respectively. Timing windows 332, 334, and 336 are represented mathematically by the symbols $w_{m-1}[n]$, $w_m[n]$, and $w_{m+1}[n]$, respectively, where m is a timing mark and n is time.

Multiplying sampling windows 332, 334 and 336 by speech signal 330 results in samples 338, 340 and 342 of FIGS. 8-5, 8-6 and 8-7, respectively. The samples are represented mathematically by $y_{m-1}[n]$, $y_m[n]$, and $y_{m+1}[n]$, where m is a timing mark that the sample is centered about and n is time. The creation of the samples through this process is shown by:

$$y_m[n]=w_m[n]x_m[n] \quad \text{EQ3}$$

Where $w_m[n]$ is zero outside of the window.

An estimate of speech signal 330 can be created by summing together each of the samples. This estimate can be represented as:

$$\tilde{x}[n] = \sum_{m=-\infty}^{\infty} y_m[n - t_m] \quad \text{EQ4}$$

Where $\tilde{x}[n]$ is the approximation of x[n]. Equation 4 above can alternatively be expressed as the convolution of an impulse train with a time varying filter as shown below:

$$\tilde{x}[n] = \sum_{m=-\infty}^{\infty} \delta_m[n - t_m] * y_m[n] \quad \text{EQ5}$$

Where $\delta_m[n-t_m]$ represents the impulse train and * represents the convolution.

The convolution of Equation 5 can be converted into a multiplication by converting $y_m[n]$ to the frequency domain. This can be accomplished by taking an N-point fast Fourier transform (FFT) according to:

$$Y_m[k] = \sum_{n=-N/2}^{N/2} y_m[n]\exp(-2\pi nk/N) \quad \text{EQ6}$$

Where k represents a discrete frequency, and $Y_m[k]$ is a complex value that indicates the magnitude and phase of a sine wave of frequency k that contributes to the speech sample. In one embodiment of the invention, k is an integer from 0 to 256, where 0 corresponds to 0 Hz and 256 corresponds to 11 kHz (given a sampling rate of 22 kHz). In such embodiments, k=1 corresponds to 43 Hz. In the discussion below, k is referred to interchangeably by its integer value and its corresponding frequency. The fast Fourier transform of Equation 6 is represented by fast Fourier transform box 380 of FIG. 7.

Figure 9:
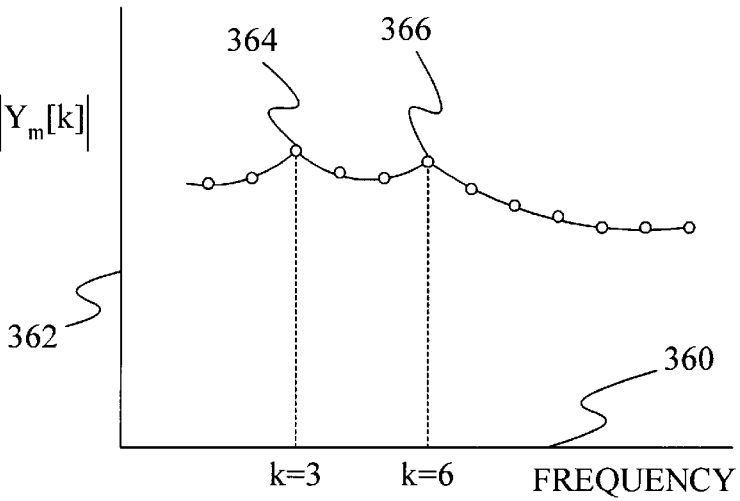
FIG. 9 is a graph of the spectral content of a sample of a speech signal.

FIG. 9 provides a graph of the magnitude portion of $Y_m[k]$ for a set of discrete frequencies k identified through the fast Fourier transform. In FIG. 9, frequency is shown along horizontal axis 360 and the magnitude of the contribution is shown along vertical axis 362. The magnitude of the contribution provided by each discrete frequency is shown as a circle in the graph of FIG. 9. For example, circle 364 represents the magnitude of the contribution provided by a frequency represented by k=3 and circle 366 represents the magnitude of the contribution provided by frequency k=6.

Figure 10:
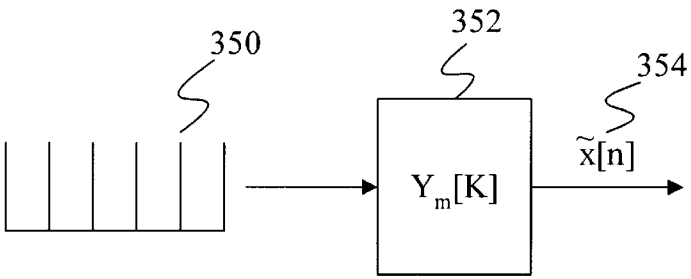
FIG. 10 is a simple spectral filter representation of the present invention.

If the spectral representation of the stored samples are used directly, an excellent approximation of the original speech signal may be created by multiplying the spectral representation of the samples by a Fourier transform of an impulse train and taking the inverse transform of the result. This is shown in the filter block diagram of FIG. 10, where an impulse train 350 is fed to a time varying frequency-domain filter 352 to produce an approximation of the original training speech signal 354.

With some modification under the present invention, this basic technique can be integrated with a prosody generation system to generate new speech signals that have a different prosody than the training speech signal. In order to accomplish this without introducing "buziness" or a metallic sound into the synthesized speech, the present invention divides the speech signal into an unvoiced portion and a mixed portion and further divides the mixed portion into an unvoiced component and a voiced component. The invention then changes the prosody of the unvoiced portion, the voiced component of the mixed portion, and the unvoiced component of the mixed portion separately through the process described further below.

Before the prosody of each portion and component of the speech signal can be changed, the present invention first isolates and stores the various components of the corpus speech signal. First, the corpus speech signal is divided into speech units such as phonemes and then each phoneme is decomposed into its constituent parts. This results in spectral distributions for an unvoiced portion, a voiced component of a mixed portion, and an unvoiced component of a mixed portion for each of the speech units.

As shown in FIG. 3-2, a speech signal consists of unvoiced portions concatenated with mixed portions. During unvoiced portions, the entire speech signal is considered to be unvoiced. As such, the spectral density of the unvoiced portion is simply equal to the spectral density of the speech signal during that time period. The spectral values of the unvoiced portion of the speech signal can be stored directly by recording the phase and magnitude of the various frequency components of the speech signal during this time period. Alternatively, the phase can be ignored in favor of just recording the magnitudes of the various frequency components. This decreases the amount of information that must be stored but does not substantially affect the quality of the synthesized speech because the phase may be approximated by a random noise vector during speech synthesis.

In the discussion below, the magnitude of the frequency components of the speech signal during any time period is identified as $H_m[k]$, which is defined as:

$$H_m[k]=|Y_m[k]| \quad \text{EQ. 7}$$

The production of $H_m[k]$ is shown in FIG. 7 as block 382.

Before separating the mixed portion into a voiced component and unvoiced component, the present invention divides the mixed portion by $H_m[k]$ as represented by:

$$E_m[k] = \frac{Y_m[k]}{H_m[k]} \quad \text{EQ. 8}$$

where $E_m[k]$ is a normalized version of the mixed portion of the speech signal, $Y_m[k]$ is the mixed portion of the speech signal, $H_m[k]$ is the magnitude of the mixed portion. The production of $E_m[k]$ is represented by block 384, which receives both $Y_m[k]$ and $H_m[k]$ from blocks 380 and 382, respectively.

The normalized mixed portion $E_m[k]$ can be separated into a voiced component $V_m[k]$ and an unvoiced component $U_m[k]$. Thus, Equation 8 can be rewritten as:

$$Y_m[k]=H_m[k]E_m[k] \quad \text{EQ. 9}$$

which can be further expanded to:

$$Y_m[k]=H_m[k](V_m[k]+U_m[k]) \quad \text{EQ. 10}$$

As with the unvoiced portion, the unvoiced component of the mixed portion can be sufficiently represented by the magnitude of each frequency component. The phase of the unvoiced component of the mixed portion does not need to be stored. Thus, Equation 10 becomes:

$$Y_m[k]=H_m[k](V_m[k]+|U_m[k]|e^{i\phi[k]}) \quad \text{EQ. 11}$$

where $\phi[k]$ is a random phase value.

Figures 1, 11:
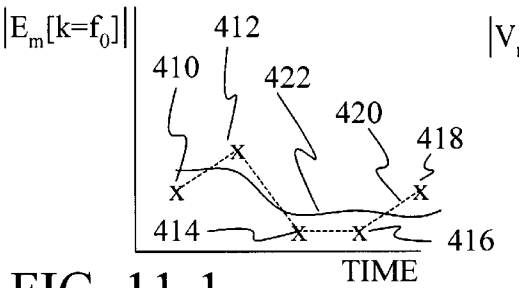
Figures 1, 12:
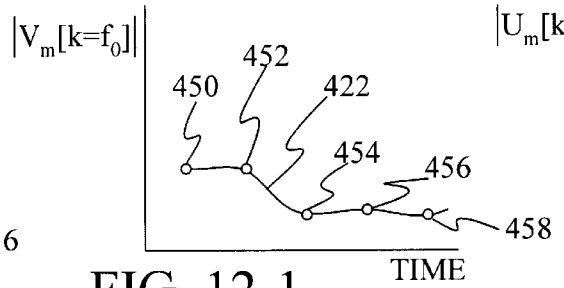

To understand how the present invention separates the voiced component from the unvoiced component in the normalized mixed portion $E_m[k]$, it is helpful to examine $E_m[k]$ for a number of different frequencies (k) across a period of time. FIGS. 11-1, 11-2, and 11-3 are graphs of $E_m[k]$ for three respective frequencies of $k=f_0$, $k=f_1$, and $k=f_2$. The magnitude of $E_m[k]$ is shown along the vertical axes of each of these graphs and time is shown along the horizontal axes. In FIG. 11-1, data points 410, 412, 414, 416, and 418 show the value of $E_m[k]$ for $k=f_0$ at several discrete time marks. Trace 420 of FIG. 11-1 represents a function that describes the change in $E_m[k=f_0]$ over time as represented by the data points. In FIG. 11-2, data points 424, 426, 428, 430, and 432 represent the values of $E_m[k=f_1]$ at various time marks aligned with the time marks of FIG. 11-1. Trace 434 represents a function that describes the changes in $E_m[k=f_1]$ over time as represented by the data points. In FIG. 11-3, data points 436, 438, 440, 442, and 444 represent the values of $E_m[k=f_2]$. Trace 446 represents a function that describes the changes in $E_m[k=f_2]$ over time as represented by the data points.

The voiced component of $E_m[k]$ can be determined from the graphs of FIGS. 11-1, 11-2, and 11-3 by recognizing that the rate of change of the voiced component is limited by the vocal cords of the speaker. Thus, the contribution of any one frequency in the voiced component will change slowly over time. Thus, if the functions depicted by traces 420, 434, and 446 are low-pass filtered to limit the rate at which they change over time, the filtered result represents the voiced component of $E_m[k]$. In the graphs of FIGS. 11-1, 11-2, and 11-3, such filtering results in filtered functions represented by traces 422, 436, and 448, respectively. This filtering can be implemented using a filtering function such as:

$$V_m[k] = \sum_{n=-L}^{L} h[n]E_{m-n}[k] \quad \text{EQ. 12}$$

where h[n] is a weighting function, L is the size of a sampling window centered on time mark "m", and n takes on all time mark values within the sampling window. In EQ. 12, h[n] can be a rectangular function that gives equal weighting to all samples in the sampling window, or a triangular function that gives more weight to samples closer to the center of the sampling window than samples at the edges of the sampling window.

Each of the traces 422, 436, and 448 of FIGS. 11-1, 11-2, and 11-3 are shown separately in FIGS. 12-1, 12-2, and 12-3, respectively, to represent the voiced component $V_m[k]$ for $k=f_0$, $k=f_1$, and $k=f_2$ where $f_0$, $f_1$, and $f_2$ are each frequencies. For each time mark found in FIG. 11-1, a value for $V_m[k=f_0]$, $V_m[k=f_1]$, and $V_m[k=f_2]$ can be determined using the respective traces 422, 436, and 448. Thus, in FIG. 12-1, trace 422 can be used to locate values 450, 452, 454, 456, and 458, that are aligned with the same time marks that are found in FIG. 11-1. Similarly, values 460, 462, 464, 466, and 468 can be determined for $V_m[k=f_1]$ from trace 436 of FIG. 12-2. Values 470, 472, 474, 476, and 478 can be determined for $V_m[k=f_2]$ from trace 448 of FIG. 12-3.

Once the values for $V_m[k]$ have been determined, the values for $U_m[k]$ can be determined using the equation:

$$U_M[k]=E_m[k]-V_m[k] \quad \text{EQ. 13}$$

Figures 1, 13:
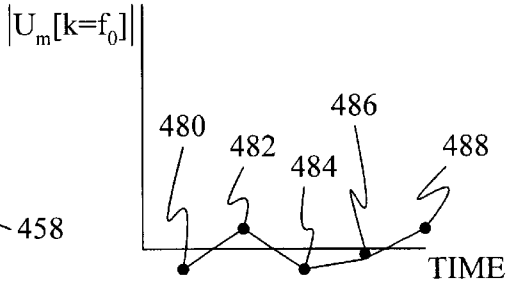
Figures 2, 11:
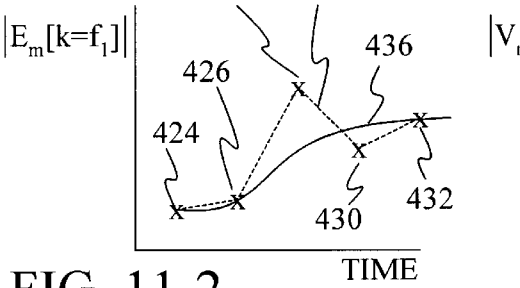
Figures 2, 12:
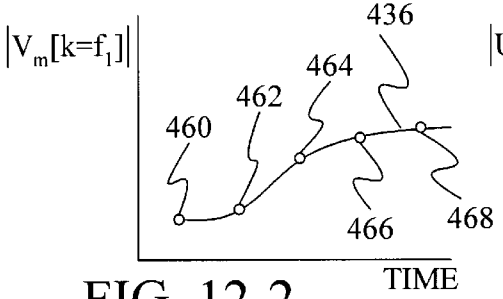
Figures 2, 13:
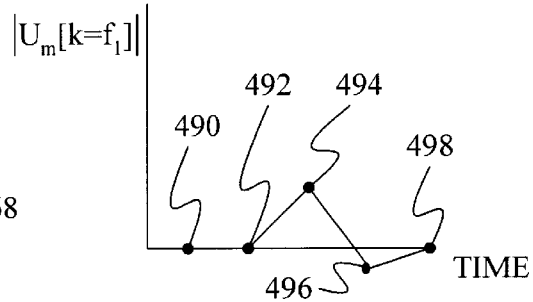
Figures 3, 11:
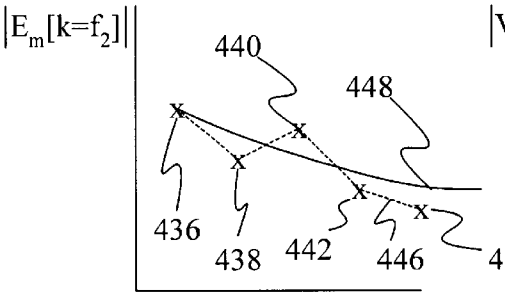
Figures 3, 12:
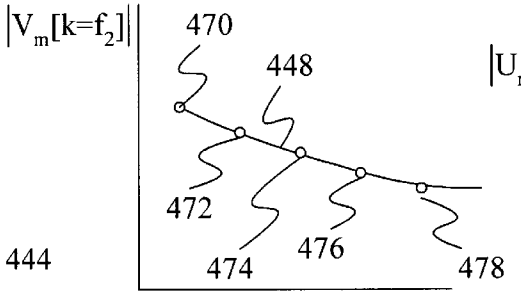
Figures 3, 13:
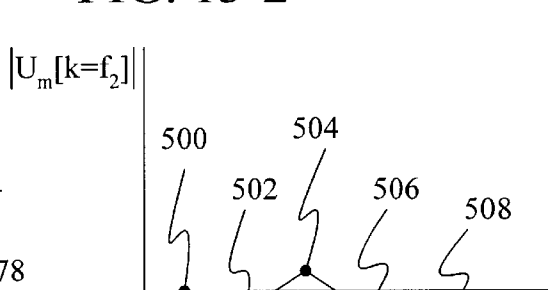

Examples of the $U_m[k]$ values produced through this calculation are shown in FIGS. 13-1, 13-2, and 13-3 for $k=f_0$, $k=f_1$, and $k=f_2$. For example, in FIG. 13-1 subtracting voiced values 450, 452, 454, 456, and 458 from mixed values 410, 412, 414, 416, and 418, respectively, results in unvoiced values 480, 482, 484, 486, and 488, respectively. For $k=f_1$ in FIG. 13-2, subtracting voiced values 460, 462, 464, 466, and 468 from mixed values 424, 426, 428 430, and 432, respectively, results in unvoiced values 490, 492, 494, 496, and 498, respectively. In FIG. 13-3 for $k=f_2$, subtracting voiced values 470, 472, 474, 476, and 478 from mixed values 436, 438, 440 442, and 444, respectively, results in unvoiced values 500, 502, 504, 506, and 508, respectively.

The filtering of the mixed portion $E_m[k]$ to produce voiced component $V_m[k]$ is represented in FIG. 7 as box 386. The production of the unvoiced component $U_m[k]$ from $E_m[k]$ and $V_m[k]$ is represented in FIG. 7 by box 388 which receives $V_m[k]$ from box 386 and $E_m[k]$ from box 384.

Once the spectral values for $H_m[k]$, $V_m[k]$, and $U_m[k]$ have been determined, the values are stored for later use in synthesizing speech. To reduce the amount of storage that the values occupy, embodiments of the present invention quantize and compress the values. To quantize the values, the present invention describes the values using predetermined values, also known as code words, that do not have as many bits as the actual values. Because the codewords have fewer bits, they take up less storage space than the actual values. However, this decrease in storage space comes at a price because the codewords are only an approximation of the actual values. They do not have enough bits to fully describe the actual values.

To compress the values, the present invention assigns one codeword to represent multiple values. For example, at any one time marker, Vm[k] will have values for 256 different discrete frequencies. Thus, $V_m[k]$ will have one value for $k=f_0$, another value for $k=f_1$, a third value for $k=f_2$ and so on. To compress these values, the present invention selects one codeword to represent a group of values. For example, one codeword may represent values for $V_m[k]$ at $k=f_5$, $k=f_6$, $k=f_7$, and $k=f_8$. This type of compression is known as vector quantization.

The first step in this type of compression involves determining which values will be grouped together. As noted above, embodiments of the invention determine the values of $H_m[k]$, $V_m[k]$, and $U_m[k]$ at 256 different frequencies. Although one possible grouping would be to divide the 256 frequencies so that roughly the same number of frequencies appear in each group, the present inventors recognize that lower frequencies are more important in speech synthesis than higher frequencies. Therefore, it is important to minimize compression error at lower frequencies but not as important to minimize compression error at higher frequencies. In light of this, embodiments of the invention create groups or sub-bands that group values of neighboring frequencies where the number of frequency values in each sub-band increases as the frequency of the values in the sub-band increases. Thus, for lower frequencies, a single codeword may represent a sub-band that consists of two values for $V_m[k]$, one at $k=f_1$, and one at $k=f_2$, while at higher frequencies a single codeword may represent a sub-band that has ten values for $V_m[k]$, one value at each of $k=f_{245}$, $k=f_{246}$, $k=f_{247}$, $k=f_{248}$, $k=f_{249}$, $k=f_{250}$, $k=f_{251}$, $k=f_{252}$, $k=f_{253}$, $k=f_{254}$, and $k=f_{255}$.

The sub-bands do not have to be the same for $H_m[k]$, $V_m[k]$, and $U_m[k]$. In fact, the present inventors have discovered that the values for $U_m[k]$ can be grouped into as few as three sub-bands without a loss in the output speech quality while the values for $H_m[k]$ and $V_m[k]$ are suitably represented by 12 sub-bands. The present inventors have also discovered that lower frequency values of $U_m[k]$ can be ignored without affecting the quality of the synthesized speech. In particular, the inventors have found that values generated for frequencies below 3 kHz may be ignored. This means that the codeword for the lowest sub-band of $U_m[k]$ can be set to zero. This also means that for values of k corresponding to frequencies below 3 kHz $V_m[k]$ is equal to $E_m[k]$.

Once the sub-bands have been identified, a proper codeword for each sub-band must be identified. Under embodiments of the invention, this involves selecting one codeword from a group of possible codewords found in a codebook. The codeword that is selected should minimize the collective compression error for the sub-band, where the collective compression error for a sub-band is the sum of the compression error caused by the substitution of the codeword for each individual value in the sub-band. The compression error caused by each substitution can be measured as the square of the difference between the codeword and the individual value it replaces.

In terms of an equation, identifying the codeword that provides the lowest collective compression error for a sub-band can be described as:

$$C_m^i = \arg\min_{W_p^r} \sum_{k=l_i}^{u_i} (V_m[k] - W_p^r)^2 \qquad \text{Eq. 14}$$

where each sub-band "i" has a lower frequency "$l_i$" and an upper frequency "$u_i$", $W_p^r$ is the p-th codeword in a codebook "r", designated for sub-band "i", and $C_m^i$ is the codeword of minimum distance for sub-band "i" at time marker "m". Equation 14 can also be used to determine the codewords for $U_m[k]$ by substituting the magnitude of $U_m[k]$ for $V_m[k]$. Only the magnitude of $U_m[k]$ needs to be quantized and compressed. The phase of $U_m[k]$ can be ignored because the inventors have found that the phase can be approximated by a random noise vector during speech synthesis. The step of quantizing and compressing $V_m[k]$ is shown as box 392 in FIG. 7. The step of quantizing and compressing the magnitude of $U_m[k]$ is shown as box 396.

For $H_m[k]$, the present inventors have discovered that additional benefits can be realized by removing a common gain factor from the $H_m[k]$ values before compressing the values. This common gain factor can be determined from the average log-energy in each sub-band, which is computed as:

$$G_m^i = \frac{1}{(u_i - l_i + 1)} \sum_{k=l_i}^{n_i} \ln H_m[k] \qquad \text{EQ. 15}$$

where each sub-band "i" has a lower frequency $l_i$ and an upper frequency $u_i$ and $G_m^i$ is the average log energy of sub-band "i" at time marker "m". The average energy at time marker "m" is then calculated as the average for all sub-bands as:

$$G_m = \frac{i}{R_h} \sum_{i=0}^{R_h-1} G_m^i \qquad \text{EQ. 16}$$

where $R_h$ is the number of sub-bands and $G_m$ is the average energy at time marker "m".

Based on the average energy $G_m$, a gain-normalized value can be defined as:

$$\overline{H}_m[k] = H_m[k]\exp(-G_m) \qquad \text{EQ. 17}$$

where $\overline{H}_m[k]$ is a gain-normalized version of $H_m[k]$.

The average energy $G_m$ can then be viewed as a gain factor that can be scalar quantized by selecting a codeword having fewer bits than $G_m$ to represent $G_m$. The codeword chosen is the codeword in a codebook that is most similar to $G_m$.

The log of the gain-normalized version of $H_m[k]$ may then be vector quantized using the techniques described above for $V_m[k]$ and the following equation:

$$C_m^i = \arg\min_{W_p^r} \sum_{k=l_i}^{u_i} (\ln \overline{H}_m[k] - \ln W_p^r)^2 \qquad \text{Eq. 18}$$

where $W_p^r$ is the p-th codeword in codebook "r" designated for sub-band "i", and $C_m^i$ is the codeword which minimizes the sum on the right-hand side of the equation.

The steps of determining the gain factor, quantizing the gain factor and quantizing and compressing the gain-normalized version of $H_m[k]$ is shown as gain-shape quantization box 390 in FIG. 7.

The codewords $|\tilde{U}_m[k]|$, $\tilde{V}_m[k]$, $\tilde{G}_m[k]$ and $\overline{H}_m[k]$ are provided to a storage controller 398 in FIG. 7, which also receives the corpus text 399. Based on the corpus text, storage controller 398 stores the codewords so that they can be indexed by their respective speech unit (phoneme, diphone, or triphone). In some embodiments, storage controller 398 also indexes the location of the speech unit within the text including the speech units that surround the current speech unit. In addition, some embodiments of the invention will select one set of codewords to represent a particular example of a speech unit that is repeated in corpus text 399. Thus if the word "six" appears in the corpus text multiple times, storage controller 399 will only store the codewords associated with one of those occurrences.

Figure 14:
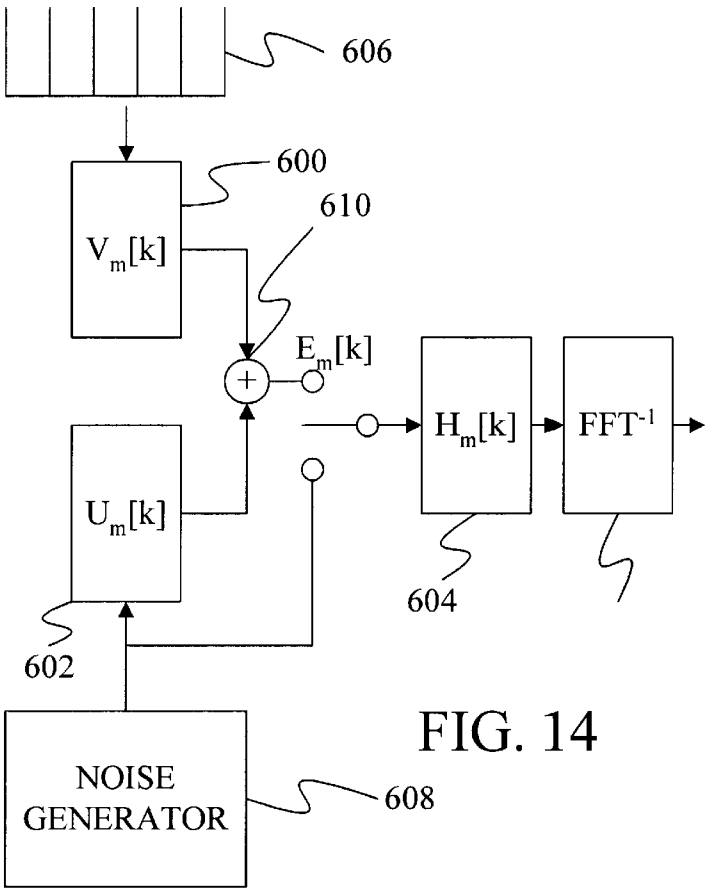
FIG. 14 a more detailed filter representation of the present invention.

An overview of the process of synthesizing speech from the stored spectral values is shown in the simple block diagram of FIG. 14. In FIG. 14, the stored values are represented as frequency domain filters. Specifically, the values for the voiced component of the mixed portion $V_m[k]$ are shown as filter 600, the values for the magnitude of the unvoiced component of the mixed portion $U_m[k]$ are shown as filter 602, and the values for the magnitude of the unvoiced portion and mixed portion of the speech signal $H_m[k]$ are shown as filter 604.

To create the speech signal, each of the filters is excited by a source. For voiced component filter 600, the source is a train of delta functions 606. The train of delta functions 606, also known as an impulse train, has a value of zero everywhere except at output time marks where it has a value equal to the gain of the impulse train. For each impulse in the train, filter 600 produces a set of magnitude and phase values that describe $V_m[k]$ at the output time mark associated with the impulse. Each set of spectral values represents a waveform. So a series of these spectral values represents a series of these waveforms, which together define the pitch and length of the voiced component of the synthesized speech. Thus, the period of the impulses in impulse train 606 determines the pitch of the synthesized speech and the length of the impulse train for any one phoneme defines the length of the phoneme. Thus, the impulse train defines the output prosody of the voiced portion of the synthesized speech.

The excitation source for unvoiced component filter 602 of FIG. 14 is a random noise generator 608, which generates random complex values representing sine waves that each have a magnitude of one but have different random phases.

Filter 602 multiplies the stored magnitude values for the unvoiced component by the complex values generated by random noise generator 608. Since the magnitude of each complex value produced by random noise generator 608 is one, this results in multiplying the magnitude of the unvoiced components by the phase components produced by random noise generator 608. Thus, random noise generator 608 provides the phase of the unvoiced component of the output speech signal.

The spectral values produced by voiced component filter 600 and unvoiced component filter 602 are summed together by a summer 610 to produce the mixed portion of the output speech signal. The mixed portion produced by summer 610 tracks the output prosody found in impulse train 606.

The excitation source for filter 604 switches between the output of summer 610 and random noise generator 608. During mixed portions of the synthesized speech, filter 604 is driven by the output of summer 610. The magnitude of the frequency components provided by summer 610 is multiplied by the magnitude values defined by filter 604. The phase values of the frequency components provided by summer 610 pass through filter 604 unchanged since filter 604 does not include any phase values of its own. During unvoiced portions, filter 604 is driven by random noise generator 608. Since all of the complex values produced by random noise generator 608 have a magnitude of one, random noise generator 608 supplies the phase values for the output speech signal during unvoiced portions of the speech signal without affecting the magnitudes defined by filter 604.

The output of filter 604 is in the frequency domain. To produce the output speech signal, the output must be converted into the time domain using an inverse fast Fourier transform 612. The output produced by inverse fast Fourier transform 612 is the synthesized speech signal.

FIG. 15 is an expanded and more detailed block diagram of the process of speech synthesis shown in FIG. 14. In FIG. 15, speech synthesis system 700 receives text 702, which is the basis for the synthesized speech. Text 702 is provided to a storage controller 704, which identifies speech units such as phonemes and diphones in the text. Storage controller 704 then searches the stored spectral values to find the spectral values that are associated with each speech unit in text 702. These spectral values include the codewords representing the voiced component ($\tilde{V}_m[k]$) and unvoiced component ($|\tilde{U}_m[k]|$) of the mixed portion of the speech signal, the gain-normalized magnitude of the entire speech signal ($\overline{H}_m[k]$), and the gain factor ($\tilde{G}_m$). The retrieved values are then released to the remainder of the speech synthesis system in the order that their respective speech units appear in text 702.

Text 702 is also provided to a semantic identifier 705, which identifies the structure of the text. In particular, semantic identifier 218 is able to distinguish questions from declarative sentences, as well as the location of commas and natural breaks in text 204.

Based on the semantics identified by semantic identifier 705, a prosody calculator 706 calculates the desired pitch and duration needed to ensure that the synthesized speech does not sound mechanical or artificial. Such prosody calculators are well known in the art and typically include a set of prosody rules. The output of prosody calculator 706 is a series of output time marks or epochs that indicate the basic pitch of the output speech signal.

The output from prosody calculator 706 is provided to three pitch interpolators 708, 710, and 712. Pitch interpolator 708 also receives codewords from storage controller 704 that represent the voiced component ($\tilde{V}_m[k]$) of the mixed portion of the speech signal and pitch interpolator 710 receives codewords from storage controller 704 that represent the unvoiced component ($|\tilde{U}_m[k]|$) of the mixed portion. Pitch interpolator 712 receives codewords that represent the spectral magnitudes ($\tilde{H}_m[k]$) of the entire speech signal at time mark "m". The codewords representing the spectral magnitudes of the entire speech signal are produced by a table look-up component 714 based on the gain-normalized magnitudes $\overline{H}_m[k]$ and the gains $G_m$ produced by storage controller 704.

Pitch interpolators 708, 710, and 712 use the time marks produced by prosody calculator 706 and their respective input values to calculate a set of output values at the output prosody. The operation of pitch interpolators 708, 710, and 712 can be seen in the graphs of FIGS. 16, 17, and 18. In FIG. 17, time is shown along horizontal axis 800 and the magnitude of $V_m[k=f_{100}]$ is shown along the vertical axis 802. Two sets of time marks are shown below horizontal axis 800. Original time marks 804 provide the time marks "m" at which $V_m[k=f_{100}]$ was sampled. Thus, the values provided by storage controller 704 of FIG. 15 occur at these time marks. Examples of such values are shown as data points 810, 812, 814, 816, 818, 820, 822, 824, and 826. Output time marks 806 are the time marks "q" produced by prosody calculator 706 that represent the output prosody.

Figure 16:
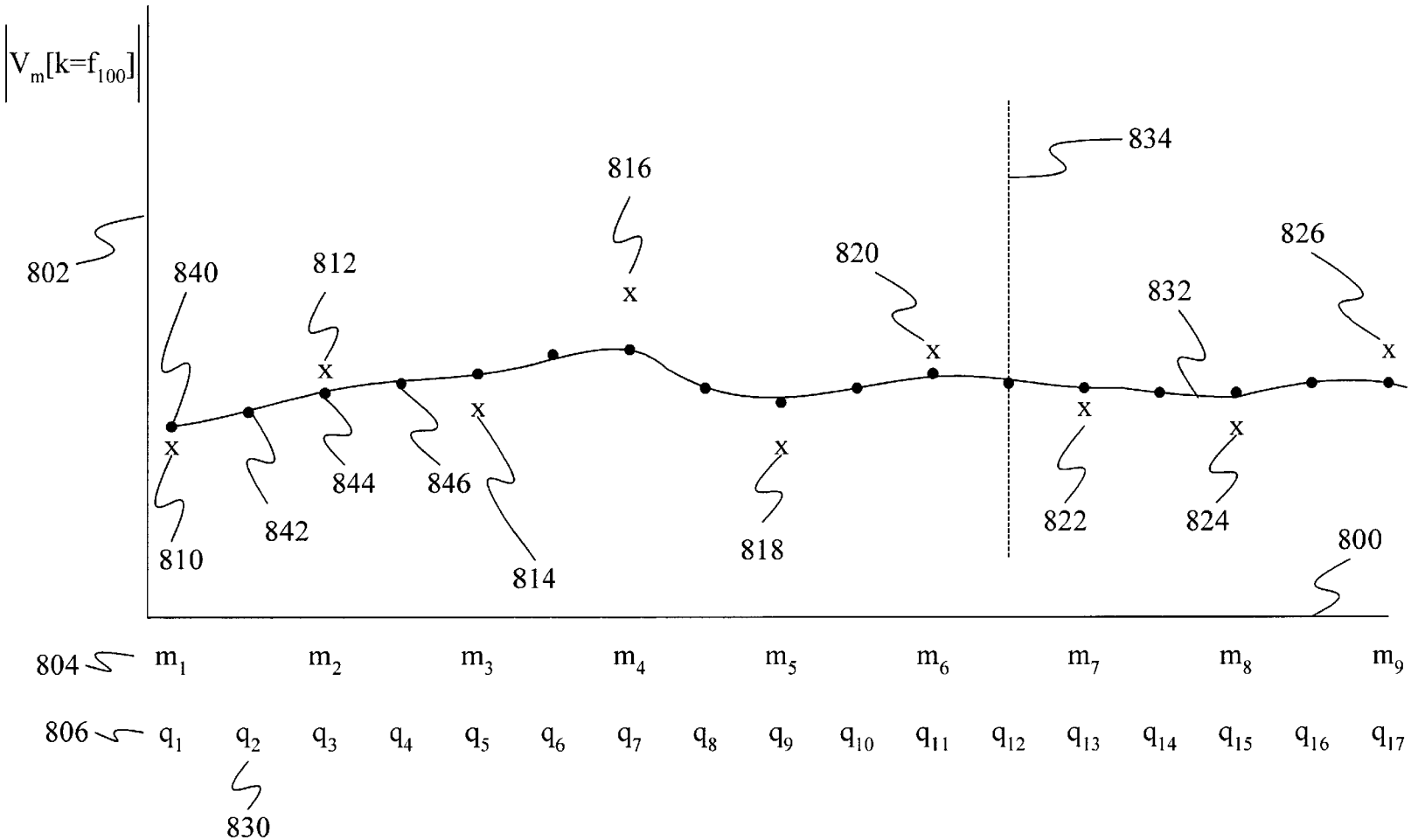
FIG. 16 is a graph of the contribution of a frequency to the voiced component of the mixed portion of the output speech signal.
Figure 17:
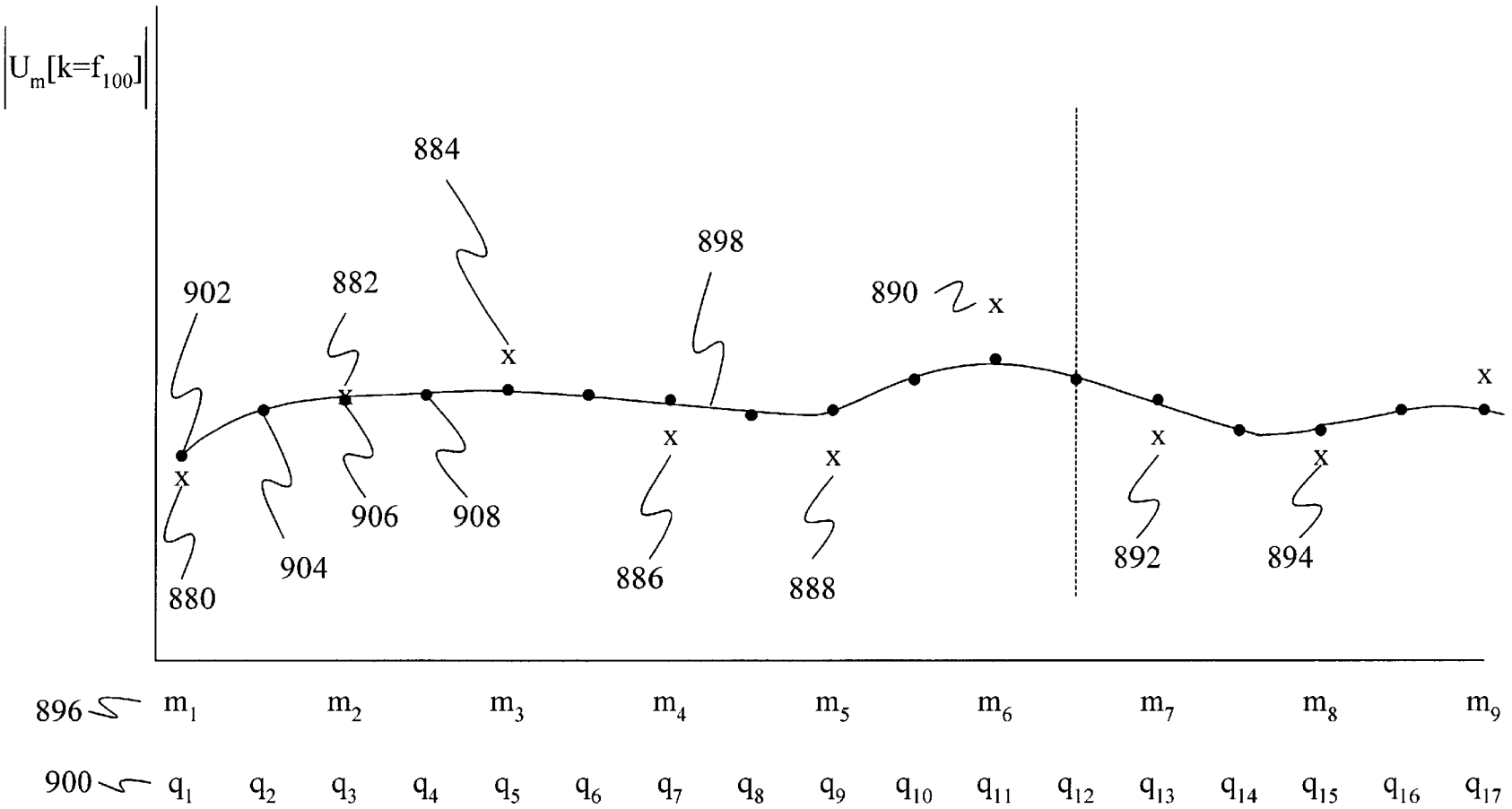
FIG. 17 a graph of the contribution of a frequency to the unvoiced component of the mixed portion of the output speech signal.

From FIG. 16, it can be seen that the values provided by storage controller 704 do not directly indicate what the value of $V_m[k=f_{100}]$ is at all of the output time marks "q". For example, storage controller 704 does not have a value for $V_m[k=f_{100}]$ at output time mark 830. To determine the value of $V_m[k=f_{100}]$ at output time mark 830, the present invention interpolates the value from the values provided by storage controller 704. The interpolation performed by the present invention is not a straight interpolation between two points that enclose the time mark of interest. Instead, the present invention realizes an advantage by performing an interpolation across a window containing multiple samples. This acts as a low pass filter that combines compression error correction with interpolation. The compression error correction is needed to reduce errors created when the sample values of the corpus speech were compressed and quantized. As noted above, each codeword that was produced to represent an actual value was only an approximation of the value. The difference between the codeword and the actual value represents a compression/quantization error.

The filtering described above can be implemented using:

$$V'_q[k] = \sum_{n=q-L}^{q+L} h[n-q]\tilde{V}_n[k] \quad \text{EQ. 19}$$

where $V'_q[k]$ is the filtered value of the voiced component at the output time mark "q", $\tilde{V}_n[k]$ is the voiced component codeword at time mark "n", "n" is a discrete time mark that takes on values of original time marks "m" located within a window of length L that is centered on output time mark "q", and h[n−q] is a weighting function that weights the contribution of a codeword based on its distance from output time mark "q". In embodiments of the invention, h[n−q] can be a rectangular function that weights all codewords equally or a triangular function that gives more weight to codewords that are closer to output time mark "q".

The right-hand side of Equation 19 represents a descriptor function that describes a respective frequency's contribution to the output speech signal over time. Using a continuous set of time values "q", this descriptor function can be seen to have a slower rate of change than the codewords. In FIG. 16, descriptor trace 832 is a graph of the descriptor function produced from the codewords associated with data points 810, 812, 814, 816, 818, 820, 822, 824, and 826 using a window length L of less than 20 ms. Note that descriptor trace 832 does not pass through all of the data points. The distance between a data point and descriptor trace 832 largely represents error introduced by the compression performed to form the data point from the corpus speech signal.

The filtering also reduces discontinuities between speech units that are being concatenated together. Without the filtering, the contribution of any one frequency to the speech signal may increase or decrease rapidly at the boundary between two speech units. This rapid change is caused by the fact that during synthesis speech units from different areas of the corpus speech signal are placed next to each other. Under the present invention, such transitions are smoothed by the filtering, which develops a smooth descriptor function that crosses speech unit boundaries. In FIG. 16, descriptor trace 832 can be seen crossing a speech unit boundary 834 while maintaining a smooth pattern for $V_m[k=f_{1000}]$.

Once the descriptor function has been determined, the value of $V_q[k]$ can be determined at any time marker. Thus, the values of $V_q[k]$ can be determined at each of the output prosody time markers 806. This results in output values 840, 842, 844, 846, and so on, with on value for every time marker "q".

Figure 19:
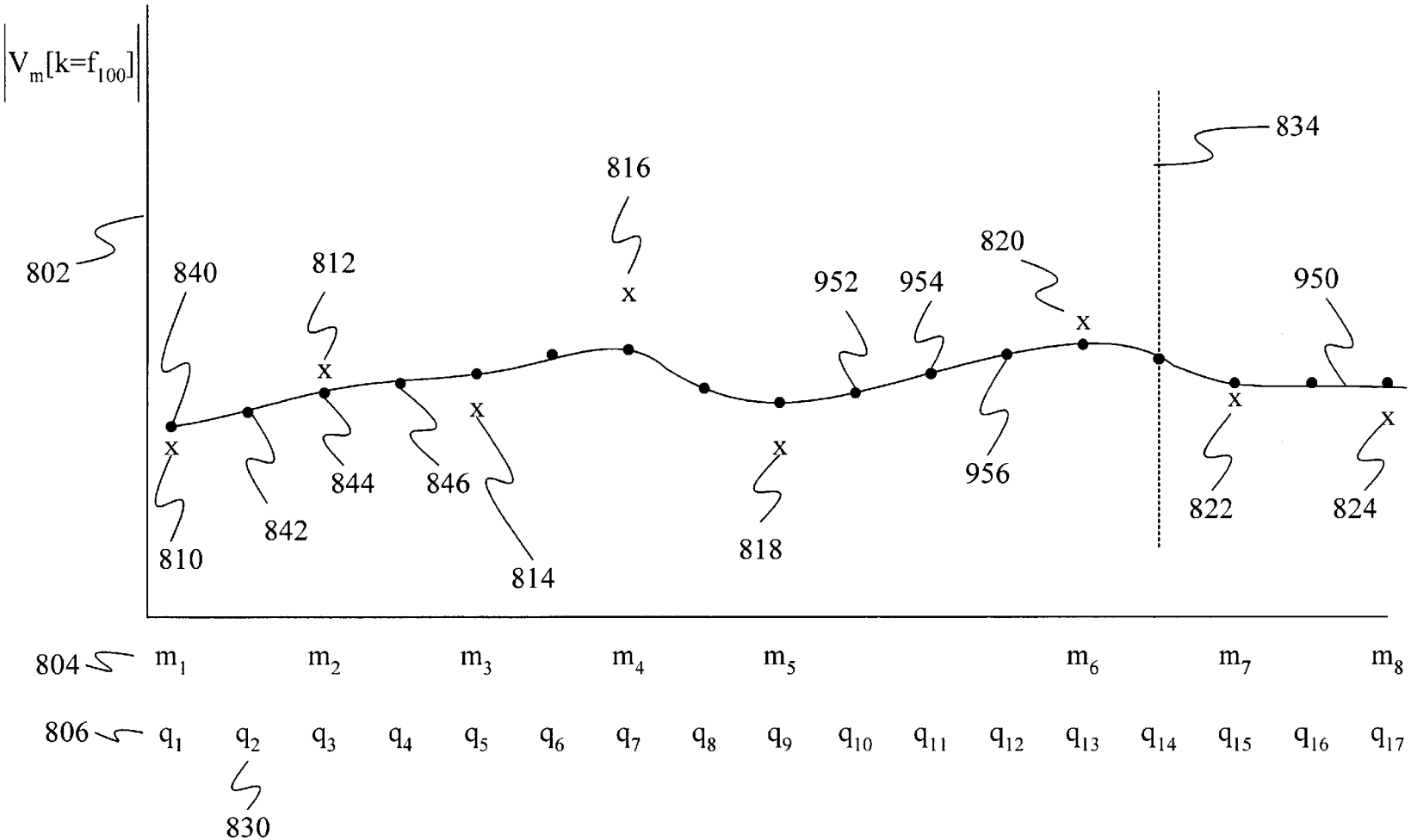
FIG. 19 is a graph of the contribution of a frequency to the voiced component of the mixed portion of the output speech signal showing lengthening.

Sections of the speech signal can also be lengthened by time shifting the codeword values taken from storage controller 704. An example of such lengthening is shown in FIG. 19 for $V_m[k=f_{100}]$. In FIG. 19, pitch interpolator 708 extends the portion of the output speech signal between data point 818 and data point 820 of FIG. 16. To extend this portion, pitch interpolator 708 time shifts data points 820, 822, and 824 by the amount by which the section is to be lengthened. The low-pass filtering is then performed based on the new time locations of the data points to produce a descriptor trace 950. The output values 952, 954, and 956 are then determined based on the location of the output time marks within the extended section as described above.

Although the descriptor function has been described in relation to the magnitude of $V_m[k]$ for simplicity of understanding, those skilled in the art will recognize that $V_m[k]$ consists of complex values that have both a magnitude and a phase. Since it is difficult to graph such complex values, only the magnitude is graphed above. However, the technique of filtering described above should be understood to be a filtering of the entire complex value for each $V_m[k]$, and the output values selected should be understood to also be complex values.

Figure 18:
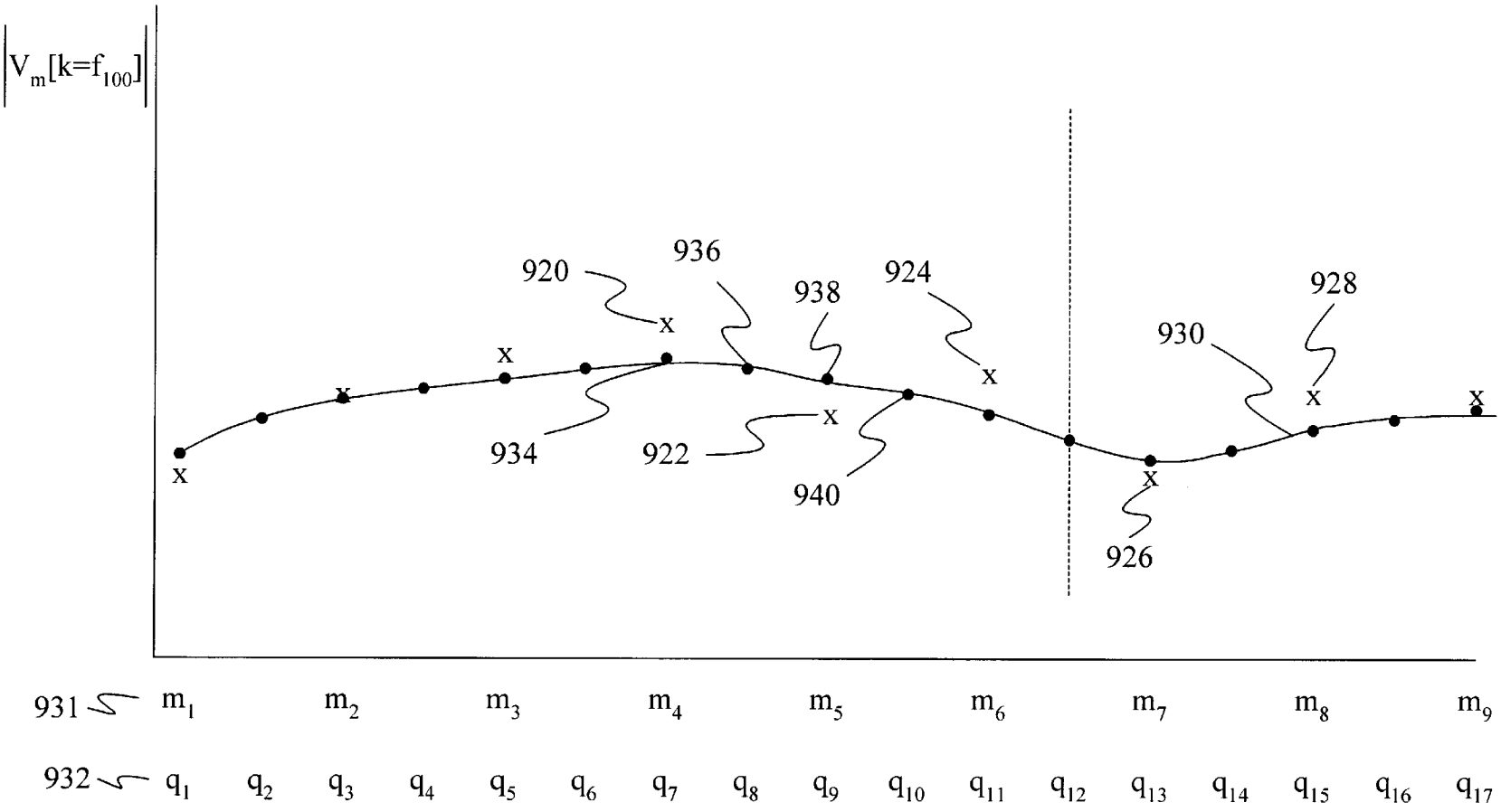
FIG. 18 is a graph of the contribution of a frequency to the magnitude of the output speech signal.

A similar pitch interpolation and compression error reduction is performed for $U_m[k]$ and $H_m[k]$ as shown in FIGS. 17 and 18. In FIG. 17, the magnitude of the unvoiced component $U_m[k]$ is shown along the vertical axis and time is shown along the horizontal axis. Codewords from storage controller 704 result in data points 880, 882, 884, 886, 888, 890, 892, and 894, one for each of the original time markers 896. Filtering the codewords produces a descriptor function represented by descriptor trace 898. Based on this descriptor function, output values designated as $U_q[k=f_{100}]$ are determined for each of the output time markers 900. Examples of these output values are represented by data points 902, 904, 906 and 908. As with the voiced component, filtering of the unvoiced component produces smooth transitions at speech unit boundaries.

In FIG. 18, codewords from table look-up component 714 produce data points such as data points 920, 922, 924, 926, and 928 for each input time mark 931. From these data points, the present invention determines a continuous descriptor function represented by trace 930, which is used to determine output values $H_q[k=f_{100}]$ for each output time marker "q" of output time line 932. Examples of such output values are represented by data points 934, 936, 938, and 940. The descriptor function for $H_q[k=f_{100}]$ also provides a smooth transition between speech units.

For $H_m[k]$ and $U_m[k]$, only the magnitudes are filtered because the stored values for $H_m[k]$ and $U_m[k]$ do not include phases. Thus, the output values $|H_q[k]|$ and $|U_q[k]|$ are not complex values and only include the magnitude of each frequency's contribution.

Since the output values $|U_q[k]|$ produced by pitch interpolator 710 only represent the magnitude of the unvoiced component, they do not describe the phase of the unvoiced component. In order to construct output values that describe both the magnitude and phase of the unvoiced component, the output magnitude values $|U_q[k]|$ are combined with random phase values produced by a noise generator 724. In one embodiment, for each magnitude value $|U_q[k]|$, noise generator 724 generates a random number between 0 and $2\pi$ to represent a phase angle. The phase angle is then used to construct a complex value $U'_q[k]$ by multiplying the magnitude value by the sine and cosine of the phase angle, respectively. The product of the magnitude and the cosine of the random phase angle represents the real part of $U'_q[k]$ and the product of the magnitude and the sine of the random phase angle represents the imaginary part of $U'_q[k]$. Together, the real and imaginary portions of $U'_q[k]$ represent the unvoiced component of the mixed portion of the output signal.

The voiced component $V'_q[k]$ produced by pitch interpolator 708 and the unvoiced component $U'_q[k]$ formed above are then added together by a summer 728 to produce mixed values $E'_q[k]$.

For mixed portions of the output speech signal, the output $|H_q[k]|$ of pitch interpolator 712 is multiplied by $E'_q[k]$ to produce output signal $Y'_q[k]$. For unvoiced portions of the output speech signal, the output of pitch interpolator 712 is combined with the random phase angles produced by random noise generator 724. In one embodiment, combining these values involves multiplying $|H_q[k]|$ by the cosine and sine of the random phase angle to construct the respective real and imaginary portions of output signal $Y'_q[k]$. During the unvoiced portions, the random noise vectors supply the phase of the various frequency components of the output signal $Y'_d[k]$. The process of switching between the random noise vectors and the mixed values to create the output signal is represented by switch 730.

Output signal $Y'_d[k]$ is then inverse fast Fourier transformed by inverse transform block 740 to produce output time-domain samples $Y_d[n]$. These time domain samples are then overlapped and added together by overlap-and-add block 742 to produce the output synthesized speech.

Although the present invention has been described with reference to particular embodiments, workers skilled in the art will recognize that changes may be made in form and detail without departing from the spirit and scope of the invention.

What is claimed is:

1. A method for synthesizing speech from input speech segments, at least one input speech segment having an original prosody and having a mixed portion with a voiced component and an unvoiced component, the method comprising:

selecting an input speech segment;

identifying an output prosody;

changing the original prosody of the selected input speech segment to produce an output speech segment so that the prosody of the output speech segment matches the output prosody through steps comprising:

changing the prosody of a voiced component of a mixed portion of the input speech segment to produce an output voiced component;

changing the prosody of an unvoiced component of the mixed portion of the input speech segment to produce an output unvoiced component by generating a frequency-domain representation of the unvoiced component directly from the input speech segment and changing the frequency-domain representation to change the prosody of the unvoiced component;

combining the output voiced component and the output unvoiced component to produce an output mixed portion for an output speech segment; and combining the output speech segment with other speech segments to form synthesized speech.

2. The method of claim 1 wherein changing the prosody of the voiced component comprises generating a frequency-domain representation of the voiced component and changing the frequency-domain representation to change the prosody of the voiced component.

3. The method of claim 2 wherein generating the frequency-domain representation comprises generating original sets of spectral values with one set of values for each of a plurality of input time marks, each set of spectral values describing the spectral content of a segment of the voiced component that extends along a period of time that includes the input time mark.

4. The method of claim 3 wherein changing the prosody of the voiced component further comprises:

creating a set of descriptor functions based on the original sets of spectral values, each descriptor function describing a respective frequency's contribution to the output speech signal over time;

identifying a plurality of output time marks different than the plurality of input time marks; and determining output sets of spectral values based on the output time marks and the descriptor functions.

5. The method of claim 4 wherein changing the prosody of the voiced component further comprises, before creating the set of descriptor functions, time shifting at least one input mark and its associated original set of spectral values such that the duration of a portion of the output voiced component is different than the duration of a corresponding portion of the voiced component of the input speech segment.

6. The method of claim 5 wherein creating a descriptor functions comprises interpolating between a plurality of spectral values.

7. The method of claim 6 wherein interpolating comprises filtering a plurality of spectral values over time such that the amount by which the spectral values can change over time is limited.

8. The method of claim 4 wherein the input speech segment comprises at least two speech units.

9. The method of claim 8 wherein creating a descriptor functions comprises filtering a plurality of spectral values over time such that the amount by which the spectral values can change between speech units is limited.

10. The method of claim 1 wherein generating the frequency-domain representation comprises generating original sets of spectral values with one set of values for each of a plurality of input time marks, each set of spectral values describing the magnitudes of a set of discrete frequencies that contribute to the content of a segment of the unvoiced component that extends along a period of time that includes the input time mark.

11. The method of claim 10 wherein changing the prosody of the unvoiced component further comprises:

creating a set of descriptor functions based on the original sets of spectral values, each descriptor function describing the magnitude of a respective frequency's contribution to the output speech signal over time;

identifying a plurality of output time marks different than the plurality of input time marks; and determining output sets of magnitudes based on the output time marks and the descriptor functions.

12. The method of claim 1 wherein changing the prosody of the unvoiced component further comprises adding spectral phases to the output sets of magnitudes to produce the output unvoiced component.

13. A method for synthesizing speech based on an input text comprising:

converting a time-domain training speech signal into a set of frequency-domain values;

quantizing the frequency-domain values into a set of codewords;

storing the codewords in a component database;

retrieving codewords from the component database based on the input text;

filtering the codewords directly to produce a descriptor function, the filtering such that the rate of change of the descriptor function is limited;

identifying an output set of frequency-domain values based on the descriptor function; and converting the frequency-domain values to time-domain values representing portions of the synthesized speech.

14. The method of claim 13 wherein a single codeword represents multiple frequency-domain values and wherein quantizing the frequency-domain values comprises selecting a codeword from a set of codewords based on which codeword best approximates the multiple frequency-domain values.

15. The method of claim 13 wherein filtering the codewords comprises filtering across two speech units in the synthesized speech.

16. The method of claim 13 wherein filtering the codewords and identifying an output set of frequency-domain values based on the descriptor function reduces errors created by quantizing the frequency-domain values into a set of codewords.

17. The method of claim 13 wherein identifying an output set of frequency-domain values comprises identifying an output prosody for the synthesized speech and determining the value of the descriptor function at time marks associated with the output prosody.

18. The method of claim 17 wherein identifying an output prosody comprises identifying a prosody that is different than a prosody of the training speech signal.

19. A computer-readable medium having computer executable instructions for synthesizing speech from input speech segments, at least one input speech segment having an original prosody and having a mixed portion with a voiced component and an unvoiced component, the method comprising:

selecting an input speech segment;

identifying an output prosody;

changing the original prosody of the selected input speech segment to produce an output speech segment so that the prosody of the output speech segment matches the output prosody through steps comprising:

changing the prosody of a voiced component of a mixed portion of the input speech segment to produce an output voiced component;

changing the prosody of an unvoiced component of the mixed portion of the input speech segment to produce an output unvoiced component by generating a frequency-domain representation of the unvoiced component directly from the input speech segment and changing the frequency-domain representation to change the prosody of the unvoiced component;

combining the output voiced component and the output unvoiced component to produce an output mixed portion for an output speech segment; and combining the output speech segment with other speech segments to form synthesized speech.

20. A computer-readable medium having computer-executable instructions for synthesizing speech based on an input text according to a method comprising:

retrieving codewords from a component database based on the input text, the codewords representing frequency-domain values indicative of a training speech signal;

filtering the codewords directly to produce a descriptor function, the filtering such that the rate of change of the descriptor function is limited;

identifying an output set of frequency-domain values based on the descriptor function; and converting the frequency-domain values to time-domain values representing portions of the synthesized speech.

* * * * *

UNITED STATES PATENT AND TRADEMARK OFFICE

CERTIFICATE OF CORRECTION

PATENT NO. : 6,253,182 B1
DATED : June 26, 2001
INVENTOR(S) : Acero

It is certified that error appears in the above-identified patent and that said Letters Patent is hereby corrected as shown below:

Column 14,
Replace equation 15 with --

$$G_m^i = \frac{1}{(u_i - l_i + 1)} \sum_{k=l_i}^{u_i} \ln H_m[k] \quad --$$

Signed and Sealed this

Ninth Day of July, 2002

*Attest:*

*Attesting Officer*

JAMES E. ROGAN
*Director of the United States Patent and Trademark Office*